US008125126B2

(12) United States Patent
Lin et al.

(10) Patent No.: US 8,125,126 B2
(45) Date of Patent: Feb. 28, 2012

(54) MULTI-FACET LIGHT EMITTING LAMP

(75) Inventors: Ming-Te Lin, Taipei County (TW); Ming-Yao Lin, Taipei County (TW); Kuang-Yu Tai, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 12/970,961

(22) Filed: Dec. 17, 2010

(65) Prior Publication Data

US 2011/0273073 A1 Nov. 10, 2011

Related U.S. Application Data

(60) Provisional application No. 61/332,623, filed on May 7, 2010.

(30) Foreign Application Priority Data

Dec. 9, 2010 (TW) ..... 99143090 A

(51) Int. Cl.
*H01J 1/02* (2006.01)

(52) U.S. Cl. ..... 313/46; 313/493; 313/634

(58) Field of Classification Search ..... 313/11, 313/46, 493, 634
See application file for complete search history.

(56) References Cited

U.S. PATENT DOCUMENTS

| | | | |
|---|---|---|---|
| 6,864,513 | B2 | 3/2005 | Lin et al. |
| 6,982,518 | B2 | 1/2006 | Chou et al. |
| 7,144,135 | B2 | 12/2006 | Martin et al. |
| 7,497,596 | B2 | 3/2009 | Ge |
| 2008/0093998 | A1 | 4/2008 | Dennery et al. |
| 2009/0200908 | A1 | 8/2009 | Mart et al. |

*Primary Examiner* — Vip Patel
(74) *Attorney, Agent, or Firm* — Jianq Chyun IP Office

(57) ABSTRACT

A multi-facet light emitting lamp including a first light source plate, a second light source plate, and a plurality of airflow channels is provided. The first light source plate has at least one first connecting terminal. The second light source plate has at least one second connecting terminal. The first connecting terminal is connected with the second connecting terminal, and an inner space is formed between the first light source plate and the second light source plate. The inner space and a space outside the multi-facet light emitting lamp are connected by the airflow channels.

28 Claims, 24 Drawing Sheets

MULTI-FACET LIGHT EMITTING LAMP

BACKGROUND

1. Technical Field

The disclosure generally relates to a lamp, and more particularly, to a multi-facet light emitting lamp.

2. Technical Art

A conventional light emitting diode (LED) bulb usually includes a sealed glass ball, a metal fin for dissipating heat, a LED light source, and a helical lamp base. The LED light source is disposed on a circuit board, and the LED light source and the circuit board are both disposed inside the glass ball. The circuit board is disposed on the metal fin. Accordingly, when the LED light source is driven, the heat generated by the LED light source is dissipated by the metal fin. However, since the metal fin or any other heat dissipating device has to be disposed in the conventional LED bulb, the weight, volume, and cost of the conventional LED bulb cannot be reduced.

SUMMARY

Accordingly, the disclosure is directed to a multi-facet light emitting lamp with improved heat dissipation performance and relatively smaller volume and lighter weight.

The disclosure provides a multi-facet light emitting lamp including a first light source plate, a second light source plate, and a plurality of airflow channels. The first light source plate has at least one first connecting terminal. The second light source plate has at least one second connecting terminal. The first connecting terminal is connected with the second connecting terminal, and an inner space is formed between the first light source plate and the second light source plate. The airflow channels connect the inner space with a space outside the multi-facet light emitting lamp.

According to an embodiment of the disclosure, the multi-facet light emitting lamp includes multiple light source plates according to the actual design requirement. The light source plates are connected through connecting terminals thereof. A plurality of airflow channels is formed at where the light source plates adjoin each other, and the airflow channels connect an outer space and an inner space of the multi-facet light emitting lamp. Thus, when the multi-facet light emitting lamp is driven, the heat generated in the multi-facet light emitting lamp is dissipated in the inner space of the multi-facet light emitting lamp and conducted out of the multi-facet light emitting lamp through a heat convection effect of the airflow channels, so that the purpose of heat dissipation is achieved.

These and other exemplary embodiments, features, aspects, and advantages of the disclosure will be described and become more apparent from the detailed description of exemplary embodiments when read in conjunction with accompanying drawings.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
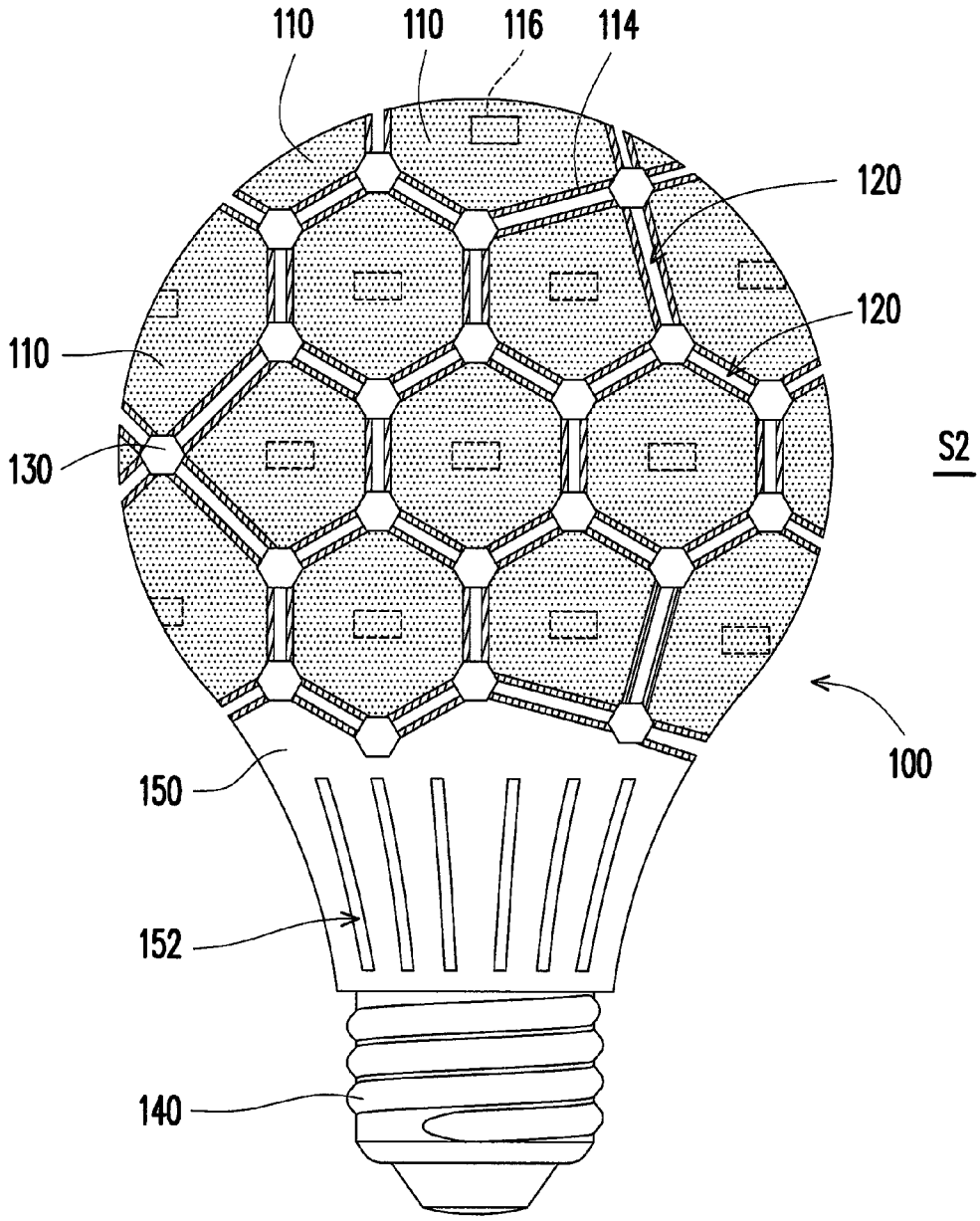
FIG. 1 is a diagram of a multi-facet light emitting lamp according to an embodiment of the disclosure.

Reference will now be made in detail to the embodiments of the disclosure, examples of which are illustrated in the accompanying drawings. Wherever possible, the same reference numbers are used in the drawings and the description to refer to the same or like parts.

Figure 2:
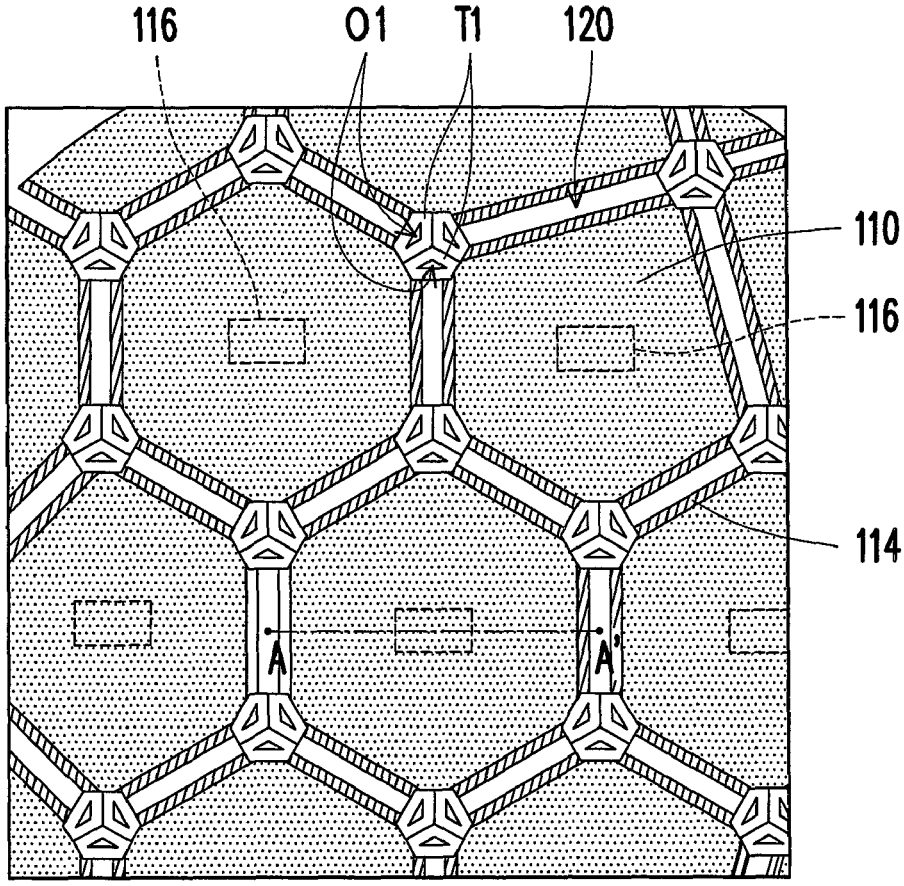
FIG. 2 is an enlarged partial view of the multi-facet light emitting lamp in FIG. 1.
Figure 4:
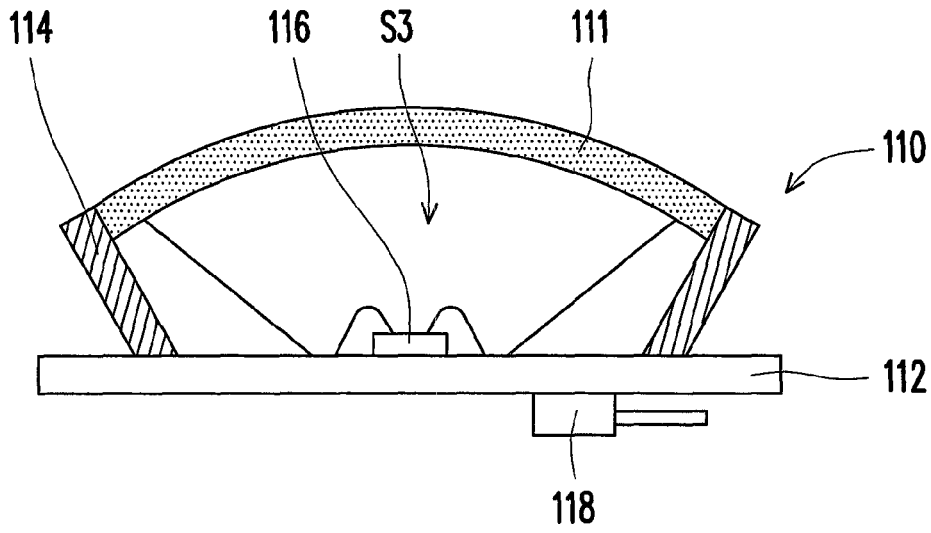
FIG. 4 is a cross-sectional view of the multi-facet light emitting lamp in FIG. 2 along line AA'.

FIG. 1 is a diagram of a multi-facet light emitting lamp according to an embodiment of the disclosure, FIG. 2 is an enlarged partial view of the multi-facet light emitting lamp in FIG. 1, and FIG. 4 is a cross-sectional view of the multi-facet light emitting lamp in FIG. 2 along line AA'. Referring to FIG. 1, FIG. 2, and FIG. 4, the multi-facet light emitting lamp 100 in the embodiment includes a plurality of light source plates 110 and a plurality of airflow channels 120. The light source plates 110 respectively have a plurality of connecting terminals T1. Each of the light source plates 110 is connected with adjacent light source plates 110 through the connecting terminals T1, and the connected light source plates 110 enclose a football-like body with an inner space (not shown), as shown in FIG. 1.

In the embodiment, the light source plates 110 may be one or a combination of circular light source plates, triangular light source plates, rectangular light source plates, quadrangular light source plates, pentagonal light source plates, hexagonal light source plates, or other polygonal light source plates. In the multi-facet light emitting lamp 100, a football-like body is formed by assembling/connecting the light source plates 110. In the embodiment, the light source plates 110 are one or a combination of pentagonal light source plates and hexagonal light source plates. However, the disclosure is not limited thereto, and in other embodiments, light source plates in other shapes may also be adopted.

As shown in FIG. 4, in the embodiment, the light source plates 110 include a substrate 112, a frame 114, and a light emitting device 116. The frame 114 is disposed on the substrate 112 and encloses a containing space S3, and the light emitting device 116 is disposed in the frame 114 and in the containing space S3. In the embodiment, the shape of the frame 114 is determined by the shapes of the light source plates 110. For example, if the light source plates 110 are pentagonal light source plates, the frame 114 can be designed in a pentagonal shape. Similarly, if the light source plates 110 are hexagonal light source plates, the frame 114 can be designed in a hexagonal shape. The light emitting device 116 is a light emitting chip in the present and following embodiments.

The connecting terminal T1 of each light source plate 110 is located at each vertex on the frame 114 and connected with the frame 114, and the number of the connecting terminals T1 is related to the shape of the frame 114. For example, if the frame 114 is in a pentagonal shape, the number of connecting terminals T1 located at the vertexes of the frame 114 is 5. Similarly, if the frame 114 is in a hexagonal shape, the number of connecting terminals T1 located at the vertex of the frame 114 is 6, as shown in FIG. 2.

Figure 3A:
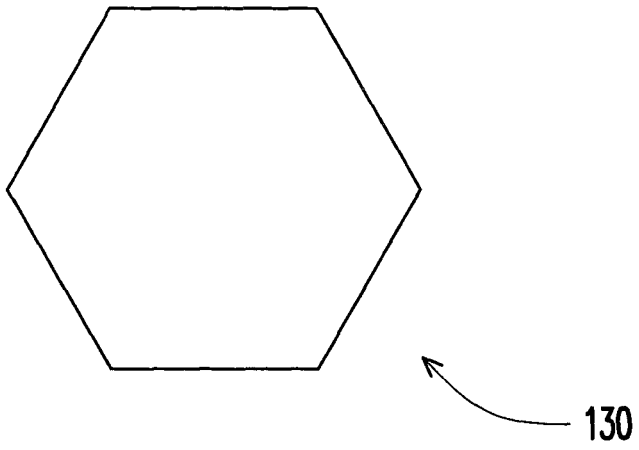
FIG. 3A and FIG. 3B are respectively a top view and a side view of a clasp.
Figure 3B:
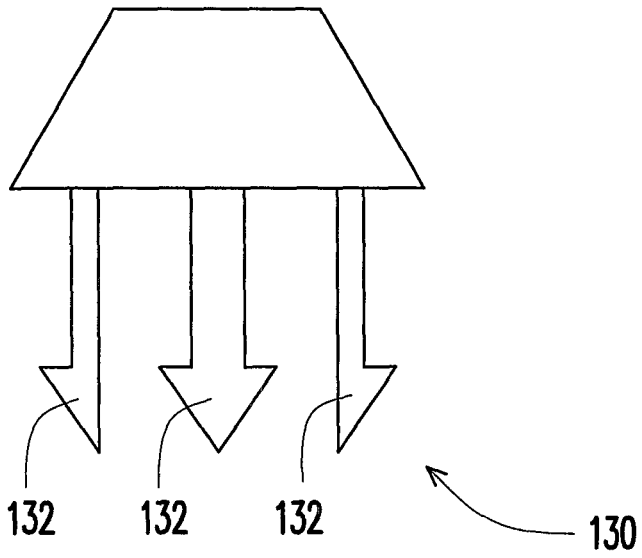

In the embodiment, each connecting terminal T1 has a clasping hole O1, as shown in FIG. 2. Thus, adjacent light source plates 110 can be clasped together through a clasp 130 illustrated in FIG. 3A and FIG. 3B. FIG. 3A and FIG. 3B are respectively a top view and a side view of a clasp. A light source plate 110 may be connected with an adjacent light source plate 110 through following technique. First, the connecting terminals T1 of the two light source plates 110 are placed side by side to form the clasping hole O1, as shown in FIG. 2. Then, the clasp 130 illustrated in FIG. 3A and FIG. 3B is pressed into the clasping hole O1 to connect the adjacent light source plates 110. All the light source plates 110 can be connected through the same technique to form the football-like body illustrated in FIG. 1. In the embodiment, each clasp 130 has three clasp feet 132, wherein the clasp feet 132 are respectively clasped with the clasping holes O1, as shown in FIG. 2 and FIG. 3. Because the top view of the clasp 130 illustrates a hexagonal example, the clasping hole is covered therefore become invisible after each clasp 130 connects adjacent light source plates 110, as shown in FIG. 1.

Referring to FIG. 4 again, the light source plates 110 further include a connector 118. The connector 118 is located below the substrate 112 and electrically connected to the light emitting device 116 for supplying power. Besides, the light source plates 110 further include an optical device 111. The optical device 111 is located above the light emitting device 116 and is connected with the frame 114 to form aforementioned containing space S3. The optical device 111 may be a light diffusion element for diffusing light beam emitted by the light emitting device 116 out of the multi-facet light emitting lamp 100. Or, the optical device 111 may also be an optical lens for dispersing the light beam emitted by the light emitting device out of the multi-facet light emitting lamp 100. Moreover, the optical device 111 may further be a phosphor-doped wavelength conversion element for converting the light beam emitted by the light emitting device 116 into light in other colors so that the light beam can be emitted out of the multi-facet light emitting lamp 100.

Additionally, an airflow channel 120 is formed between adjacent two light source plates 110. The airflow channels 120 connect the inner space of the multi-facet light emitting lamp and a space S2 out of the multi-facet light emitting lamp 100, as shown in FIG. 1 and FIG. 2. To be specific, because in the embodiment, a light source plate 110 is connected with an adjacent light source plate 110 through the connecting terminals T1, the frames 114 of the light source plates 110 do not contact each other closely. Accordingly, an opening (i.e., an air flow channel 120) is formed between the frames 114 of the light source plates 110, and the airflow channels 120 connect the inner and outer spaces of the multi-facet light emitting lamp. Moreover, because the light emitting device 116 will produce heat when the light source plates 110 are activated to emit light and the light emitting device 116 is disposed on the substrate 112, the heat is conducted to the substrate 112 and dissipated through the substrate 112.

In the embodiment, the multi-facet light emitting lamp 100 has a plurality of airflow channels 120, and the airflow channels 120 connect the inner and outer spaces of the multi-facet light emitting lamp 100. Thus, when the heat produced by the light emitting device 116 is conducted to the substrate 112 and dissipated through the same, the heat is dispersed into the inner space of the multi-facet light emitting lamp 100. In this case, since the multi-facet light emitting lamp 100 has the airflow channels 120, the heat accumulated in the inner space of the multi-facet light emitting lamp 100 is conducted out of the multi-facet light emitting lamp 100 through the airflow channels 120, so that the purpose of heat dissipation is accomplished. In addition, because the airflow channels 120 are distributed everywhere (the upper portion and the lower portion) on the multi-facet light emitting lamp 100, based on the fact that warm air rises and cold air falls, the heat produced by the light emitting device 116 rises towards the airflow channels 120 on the upper portion and conducted out of the multi-facet light emitting lamp 100, fresh air with lower temperature enters the inner space through the airflow channels 120 on the lower portion. In other words, the multi-facet light emitting lamp 100 in the embodiment has an optimal heat convection structure such that heat produced by the light emitting device 116 can be efficiently conducted out of the multi-facet light emitting lamp 100. Thereby, no conventional heat dissipation fin or cooling device is adopted by the multi-facet light emitting lamp 100 in the embodiment for dissipating heat produced by the multi-facet light emitting lamp 100.

In the embodiment, the multi-facet light emitting lamp 100 further includes a lamp base 140 and a heat-dissipation lamp housing 150. The heat-dissipation lamp housing 150 is disposed below the football-like body and connected with some light source plates 110. The lamp base 140 is below the heat-dissipation lamp housing 150 and electrically connected to foregoing light source plates 110. The football-like body is installed on the heat-dissipation lamp housing 150, and the heat-dissipation lamp housing 150 is assembled onto the lamp base 140. However, the assembly procedure is not limited in the disclosure, and which can be changed according to the technique and design adopted. To be specific, the heat-dissipation lamp housing 150 may be a metal pipe having a plurality of airflow openings 152. Accordingly, besides circulating through the airflow channels 120, air in the inner space of the multi-facet light emitting lamp 100 may also circulate through the airflow openings 152 of the heat-dissipation lamp housing 150. Additionally, in the embodiment, the lamp base 140 is implemented in a helical form. Namely, the multi-facet light emitting lamp may be attached to a general socket for emitting light. However, the disclosure is not limited thereto, and the lamp base 140 may also be implemented in any other form, such as that adaptable to a general double-hole socket, triple-hole socket, or any socket pattern adopted by another lamp.

Figure 5:
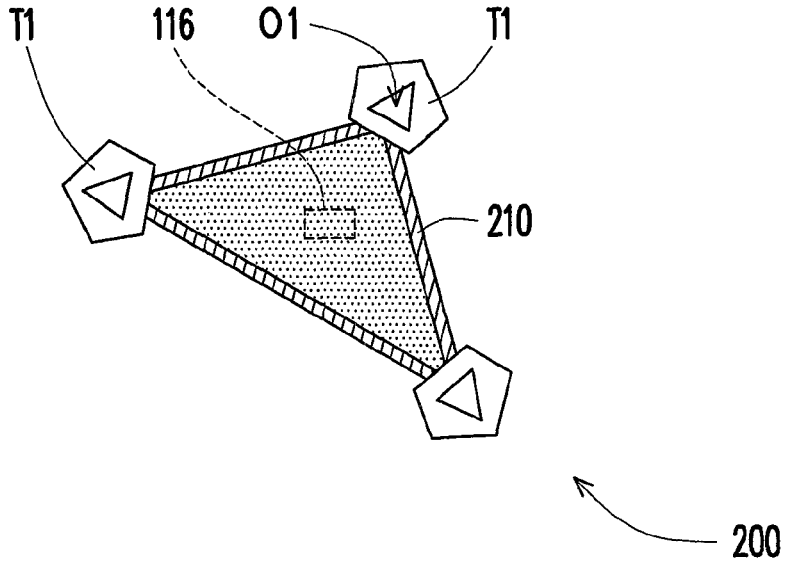
FIG. 5 is a diagram of a triangular light source plate.

Moreover, even though pentagonal light source plates and hexagonal light source plates (as illustrated in FIG. 2) are adopted in the embodiment to construct the football-like body illustrated in FIG. 1, the football-like body may also be constructed by using light source plates in other shapes, such as the triangular light source plate 200 illustrated in FIG. 5. The triangular light source plate 200 has a similar structure as that of the light source plate 110 illustrated in FIG. 4. However, the difference between the two light source plates is that the triangular light source plate 200 has three connecting terminals T1, and the frame 210 thereof is in a triangular shape, wherein the light emitting device of the triangular light source plate 200 is also located within the frame 210. To be specific, because both pentagon and hexagon can be equally divided into a plurality of triangles, the triangular light source plate 200 in the embodiment may also be applied to the football-like body described above, and the connection technique adopted herein is the same as that described above therefore will not be described herein.

Figure 6:
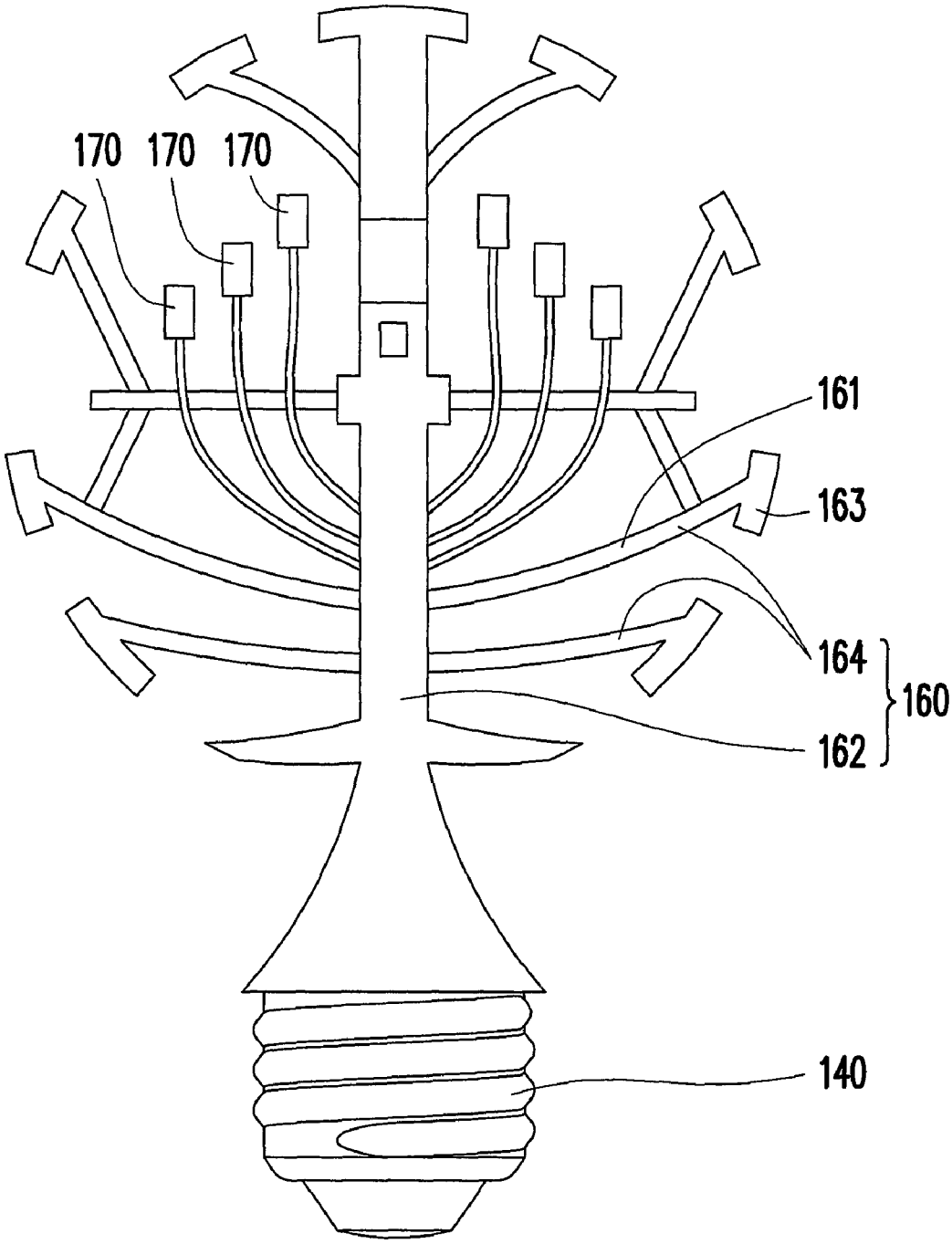
FIG. 6 is a diagram of a supporting frame that can be installed in a multi-facet light emitting lamp.

In the embodiment, the supporting strength and mechanical strength of the football-like body constructed by connecting the light source plates 110 through the connecting terminals T1 are determined by the light source plates 110 and connecting terminals T1 adopted. Generally speaking, the supporting strength and mechanical strength of the football-like body should allow the football-like body to be used in an illumination device for a long term. However, in order to further improve the mechanical strength of the multi-facet light emitting lamp 100, a supporting frame 160 (as shown in FIG. 6) may be further disposed in the multi-facet light emitting lamp 100 for supporting the football-like body composed of the light source plates 110. To be specific, the supporting frame 160 has a supporting trunk 162 and a plurality of supporting branches 164. The supporting trunk 162 is suitable for being extended into the inner space of the football-like body for supporting the football-like body. The supporting branches 164 are disposed on the supporting trunk 162 and within the inner space. The supporting branches 164 are suitable for supporting the light source plates 110. The supporting trunk 162 may be a hollow column. The supporting branches 164 may include a bracket 161 and a supporting holder 163. The supporting holder 163 is connected to a free end of the bracket 161. The supporting branches 164 may be arranged regularly or irregularly.

In the embodiment, at least one of the supporting trunk 162 and the supporting branches 164 is hollow, which is related to the electrical connections. For example, if the supporting trunk 162 is hollow, the multi-facet light emitting lamp 100 includes a plurality of conductive wires 170. The conductive wires 170 are respectively buried in the hollow space of the supporting trunk 162 and are respectively and electrically connected to the connectors 118 of the light source plates 110 for driving the light source plates 110 to emit light. In addition, the lamp base 140 is also physically connected with the supporting frame 160, and the conductive wires 170 buried in the supporting trunk 162 are electrically connected to the lamp base 140. Accordingly, when an external power source supplies power to the lamp base 140, the light source plates 110 are driven through the conductive wires 170 to emit light. However, the disclosure is not limited to foregoing description, and in other embodiments, the conductive wires 170 may not be buried in the supporting frame 160 but are directly electrically connected to the light source plates 110 in the inner space of the football-like body.

Figure 7:
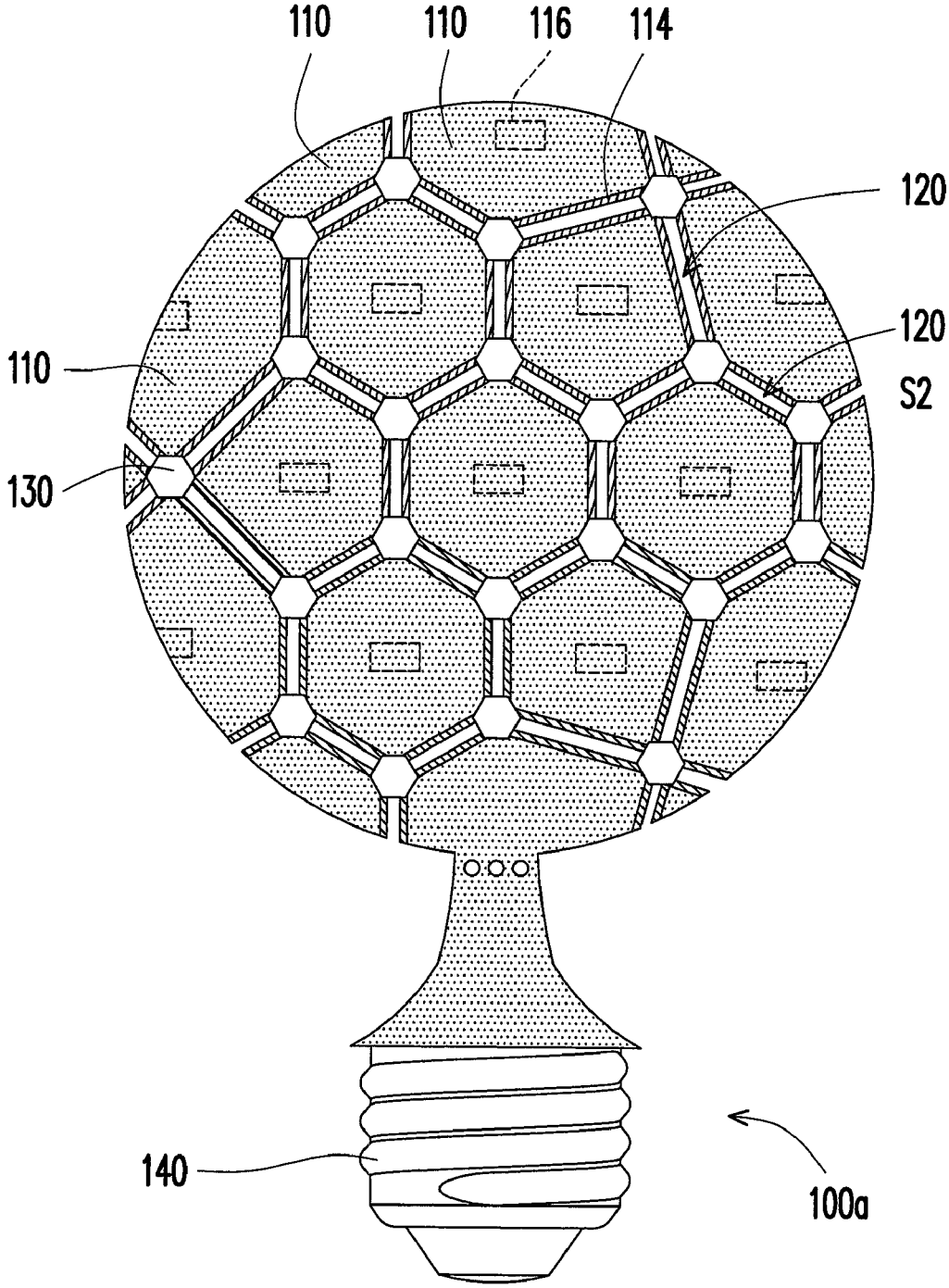
FIG. 7 is a diagram of a multi-facet light emitting lamp according to an embodiment of the disclosure.

As shown in FIG. 7, the multi-facet light emitting lamp 100*a* does not have the heat-dissipation lamp housing 150 as the multi-facet light emitting lamp 100 illustrated in FIG. 1. Thus, compared to the multi-facet light emitting lamp 100 in FIG. 1, the multi-facet light emitting lamp 100*a* in FIG. 7 has more light source plates 110. Because the multi-facet light emitting lamp 100*a* also has the airflow channels 120, it offers the same advantages as those of the multi-facet light emitting lamp 100 described above, which will not be described herein.

Figure 8:
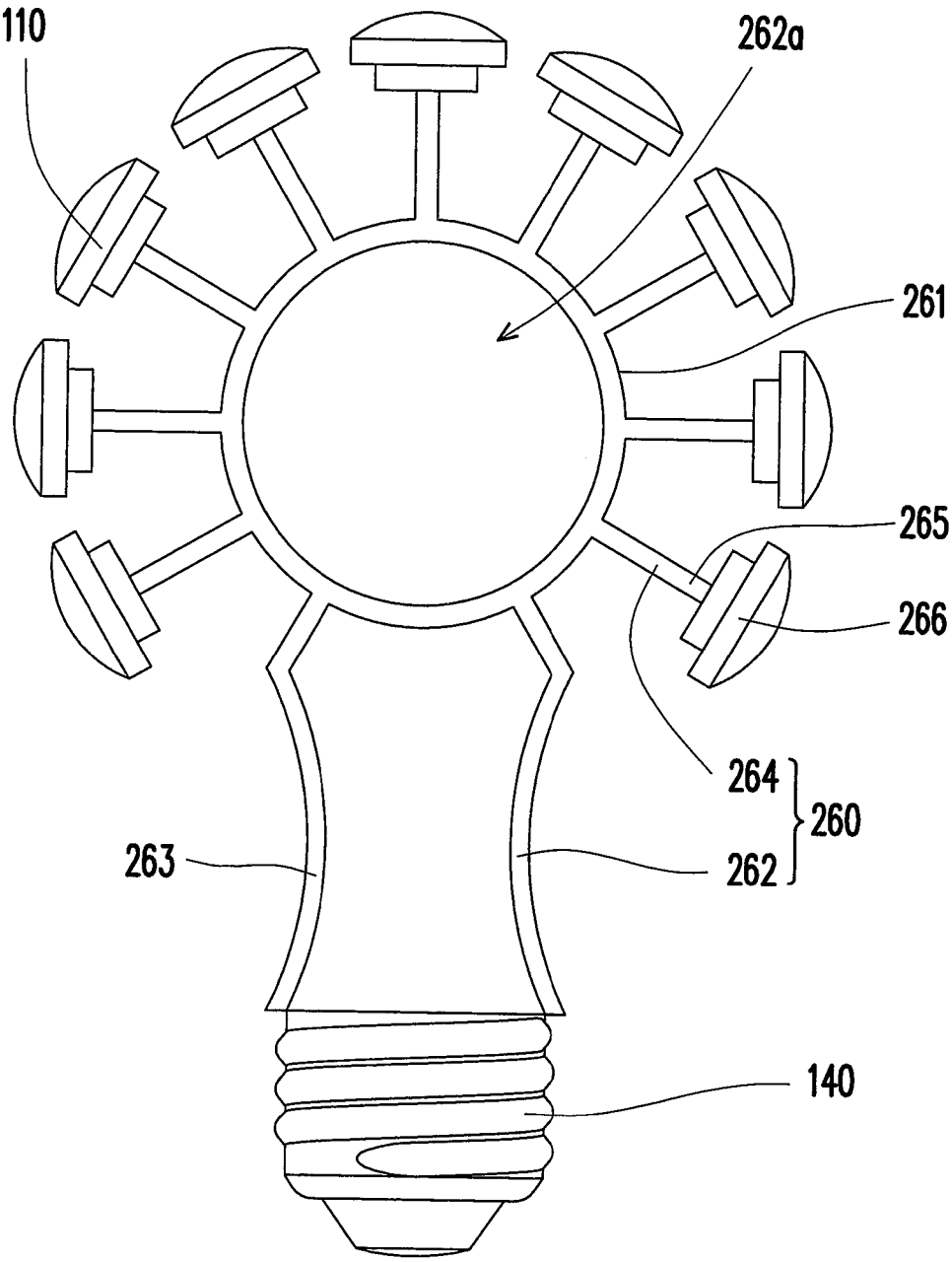
FIG. 8 is a diagram of a supporting frame that can be installed in a multi-facet light emitting lamp.

In another embodiment, the supporting frame 160 illustrated in FIG. 6 may also be designed like the supporting frame 260 illustrated in FIG. 8. Referring to FIG. 8, the supporting frame 260 has a supporting trunk 262 and a plurality of supporting branches 264. The supporting trunk 262 is suitable for being extended into the inner space of the football-like body for supporting the football-like body. The supporting branches 264 are located on the supporting trunk 262 and within the inner space. The supporting branches 264 are suitable for supporting the light source plates 110. In particular, the supporting trunk 262 encloses a hollow space 262*a*, and the hollow space 262*a* is suitable for containing a driving circuit, conductive wires, or other suitable circuits. In addition, the lamp base 140 is also physically connected with the supporting frame 260, as shown in FIG. 8. The supporting trunk 262 may have a shape of a hollow ball 261 connected with a hollow column 263. The supporting branches 264 may include a bracket 265 and a supporting holder 266, wherein the supporting holder 266 is connected to a free end of the bracket 265. The supporting branches 264 may be arranged regularly or irregularly.

Figure 9:
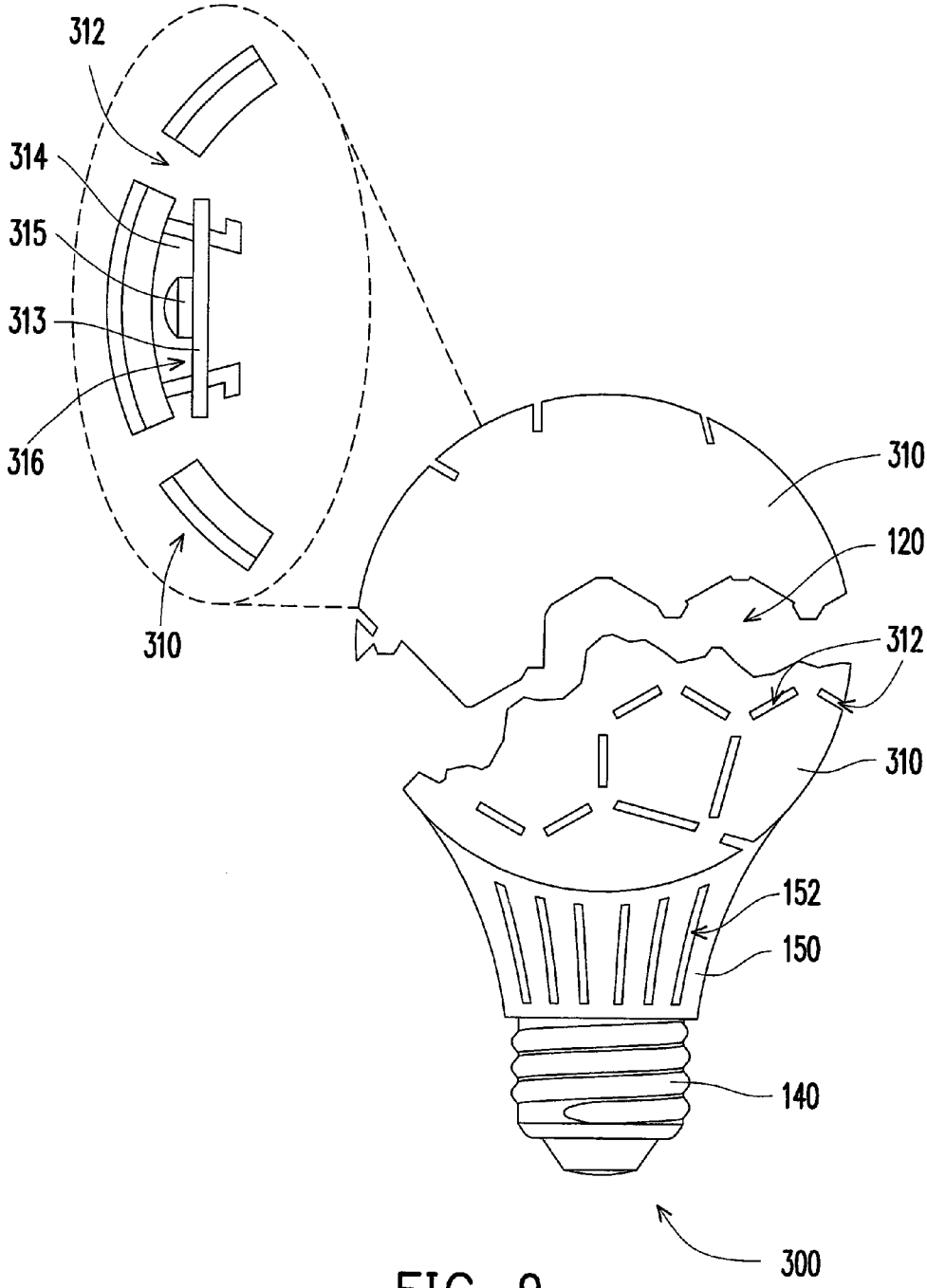
FIG. 9 is a diagram of a multi-facet light emitting lamp according to an embodiment of the disclosure.

FIG. 9 is a diagram of a multi-facet light emitting lamp according to another embodiment of the disclosure. The multi-facet light emitting lamp 300 in the embodiment is similar to the multi-facet light emitting lamp 100 illustrated in FIG. 1, and the difference between the two multi-facet light emitting lamps is that in the multi-facet light emitting lamp 100 illustrated in FIG. 1, the football-like body is constructed by connecting the light source plates 110, while in the multi-facet light emitting lamp 300 of the embodiment, the football-like body is constructed by connecting two light source plates 310. In the embodiment, the light source plates 310 may be flexible substrate and may be implemented as hemispheroids. Each of the light source plates 310 has an airflow channel 312, and the airflow channel 312 may be formed by drilling a hole in the light source plate 310, wherein the hole may be in a circular shape, a rectangular shape, a strip shape, or any other shape. The football-like body illustrated in FIG. 9 is constructed by assembling the two light source plates 310. To be specific, if the two light source plates 310 are assembled through the connecting terminals T1, aforementioned airflow channels 120 are formed at where the two light source plates 310 are connected. In other words, because the multi-facet light emitting lamp 300 in the embodiment also has the airflow channels 120 and 312, the multi-facet light emitting lamp 300 offers an optimal heat dissipation effect during its operation. Besides, the multi-facet light emitting lamp 300 offers easy assembly since the football-like body illustrated in FIG. 9 is constructed by using only two light source plates.

The light source plates 310 include a substrate 313, a frame 314, and a light emitting device 315. The frame 314 is disposed on the substrate 313 and encloses a containing space 316, and the light emitting device 315 is disposed in the frame 314 and within the containing space 316. The frame 314 is disposed on the light source plates 310 so that the substrate 313 can be disposed on the frame 314.

Figure 10A:
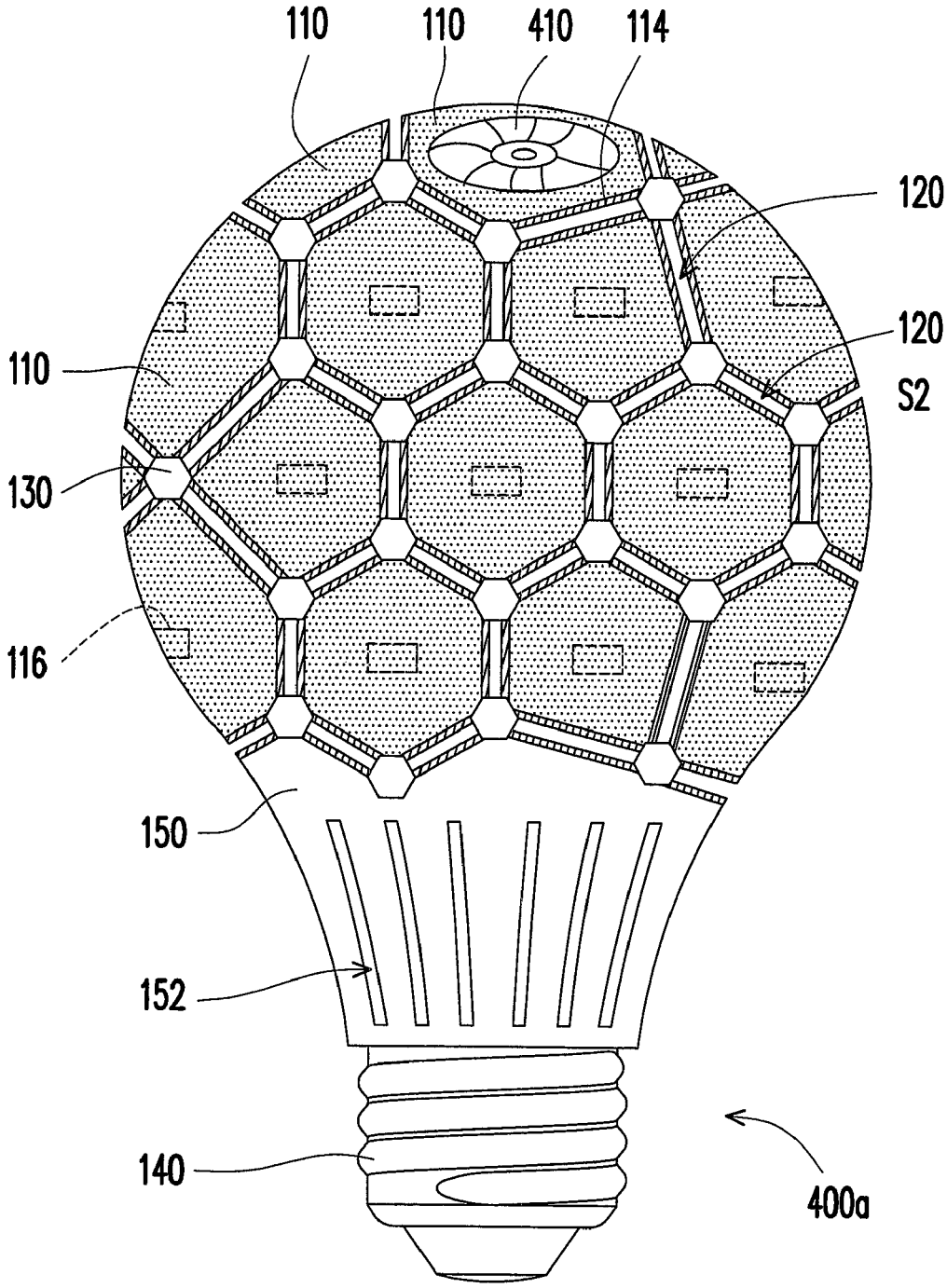
FIG. 10A and FIG. 10B are diagrams respectively illustrating a multi-facet light emitting lamp installed with a fan.
Figure 10B:
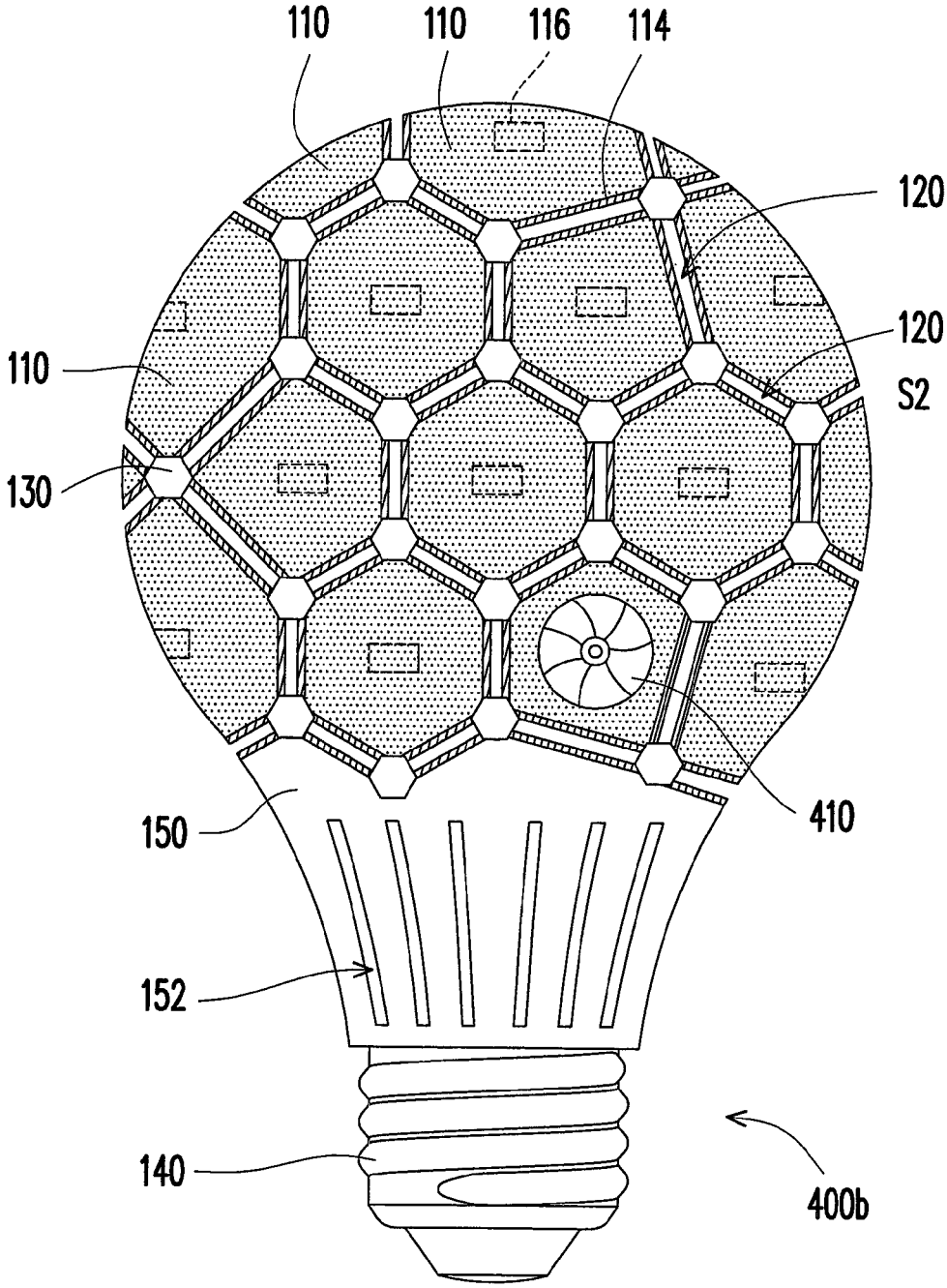

Besides improving the heat dissipation performance of the multi-facet light emitting lamp 100 by adopting the heat-dissipation lamp housing, in other embodiments, the heat dissipation performance may also be improved by adopting other heat dissipating devices. For example, in the multi-facet light emitting lamp 400*a* illustrated in FIG. 10A, a fan 410 is installed for extracting hot air out of the inner space, so as to facilitate the air circulation. To be specific, the multi-facet light emitting lamp 400*a* in FIG. 10A is similar to the multi-facet light emitting lamp 100 described above. However, in the multi-facet light emitting lamp 400*a*, a light source plate 110 at the top is replaced by the fan 410, and an airflow is produced between the inner space and the space out of the multi-facet light emitting lamp by using the fan 410, so that the heat produced during the operation of the multi-facet light emitting lamp 400 can be effectively dissipated. In the embodiment, the fan 410 may be disposed at a specific light source plate according to the actual design requirement. In the multi-facet light emitting lamp 400*b* illustrated in FIG. 10B, the fan 410 may be disposed at the lower portion of the multi-facet light emitting lamp 400*b* (i.e., a specific light source plate 110 on the lower portion may be replaced by the fan 410).

Figure 11A:
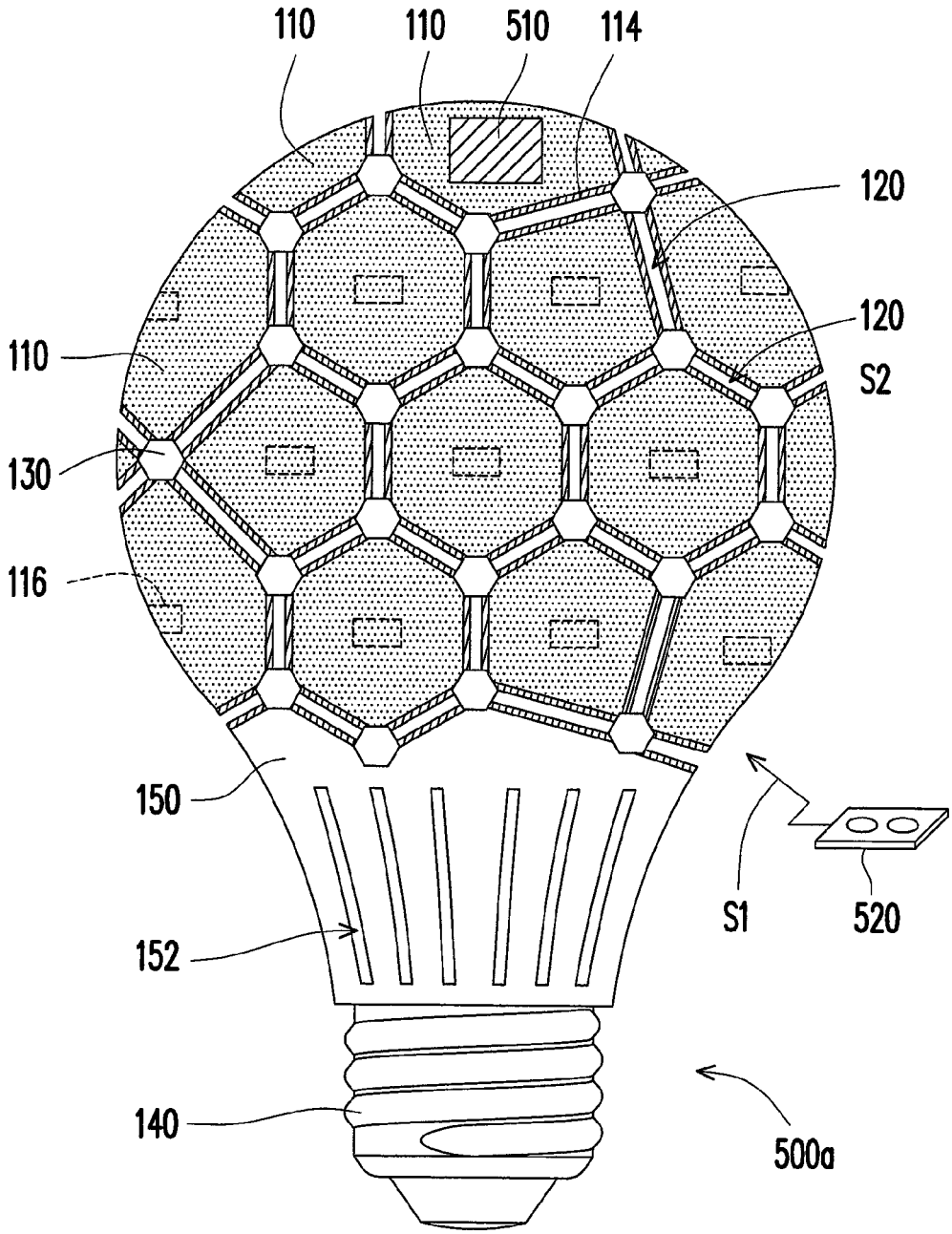
FIG. 11A and FIG. 11B are diagrams illustrating how a multi-facet light emitting lamp is operated.
Figure 11B:
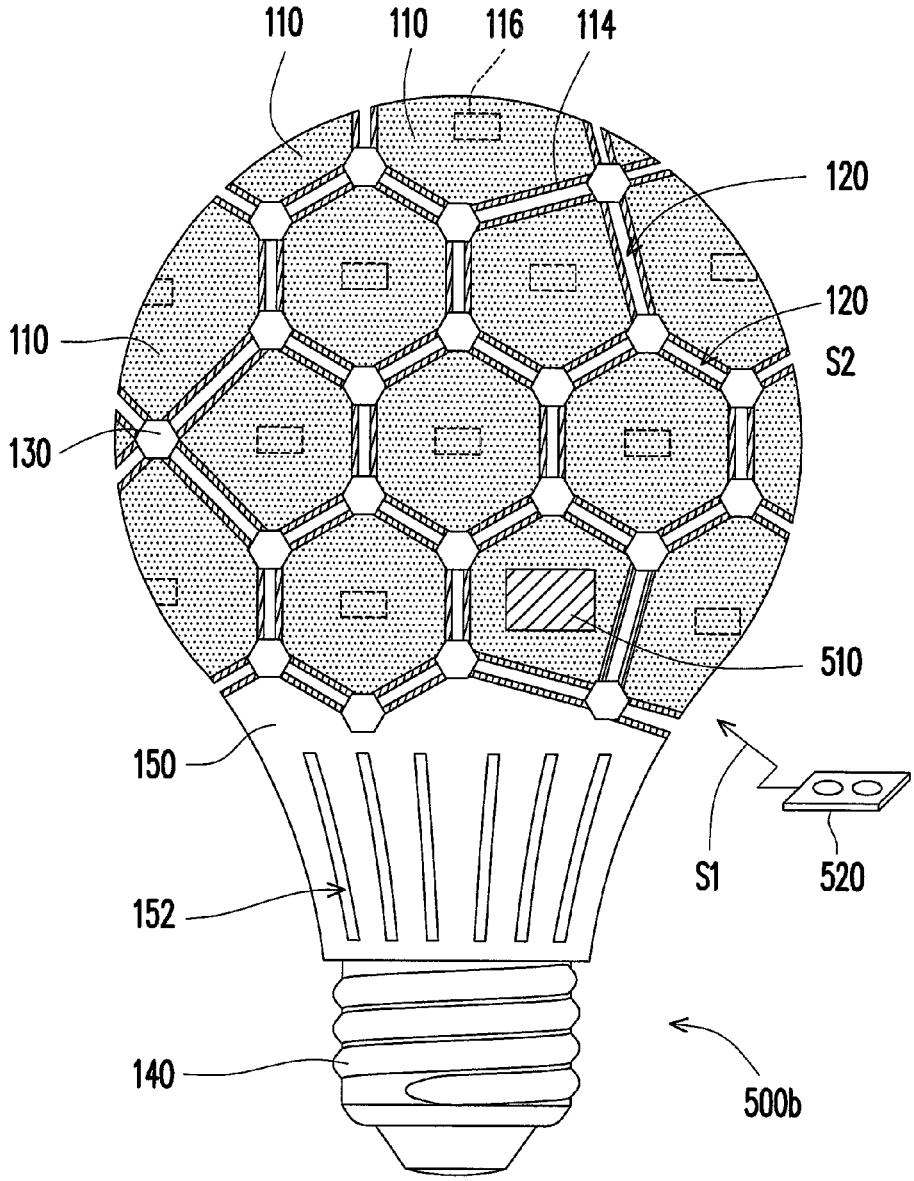

FIG. 11A and FIG. 11B are diagrams respectively illustrating how a multi-facet light emitting lamp is operated. Referring to FIG. 11A first, the multi-facet light emitting lamp 500*a* in the embodiment is similar to the multi-facet light emitting lamp 100 illustrated in FIG. 1. However, one of the light source plates 110 in the multi-facet light emitting lamp 500*a* is replaced by a wireless control module 510. The wireless control module 510 is located on the top of the football-like body for receiving an external signal S1 and turning on or off the light source plates. A user can output the signal S1 through a remote control 520. Namely, the light source plates 110 can be turned on or off through the remote control. Such a remote control mechanism may turn on all or some of the light source plates on the football-like body according to the user requirement and the design, and foregoing description is only an example. In addition, referring to FIG. 11B again, the wireless control module 510 may also be located at the bottom of the football-like body.

In the embodiments described above, a multi-facet light emitting lamp having a football-like body constructed with multiple light source plates and the variations thereof are described. In other embodiments, multi-facet light emitting lamps having optimal heat dissipation performance and other 3D structures constructed with the light source plates may also be provided, which will be described in following paragraphs.

Figure 12:
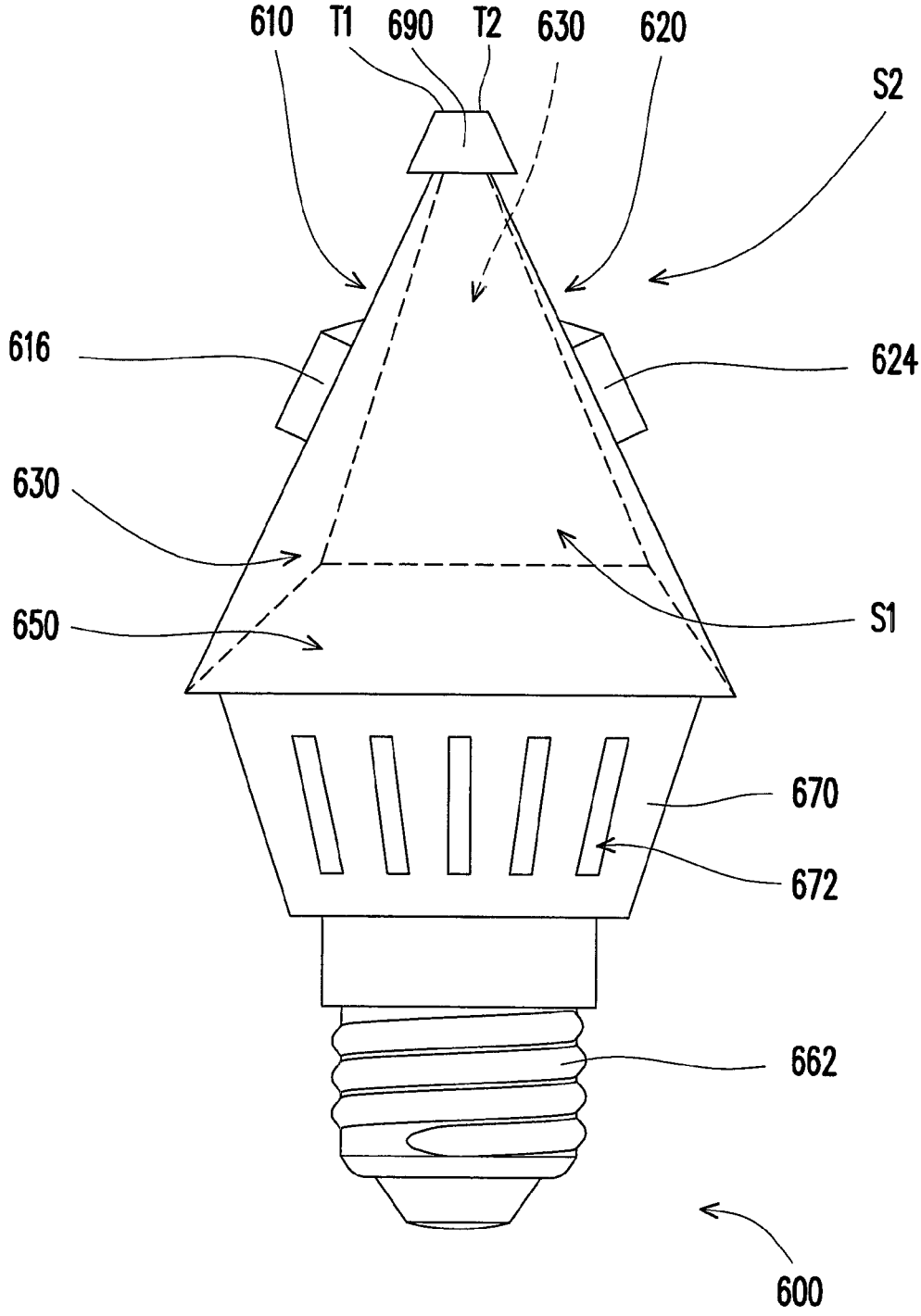
FIG. 12 is a diagram of a multi-facet light emitting lamp according to an embodiment of the disclosure.
Figure 13A:
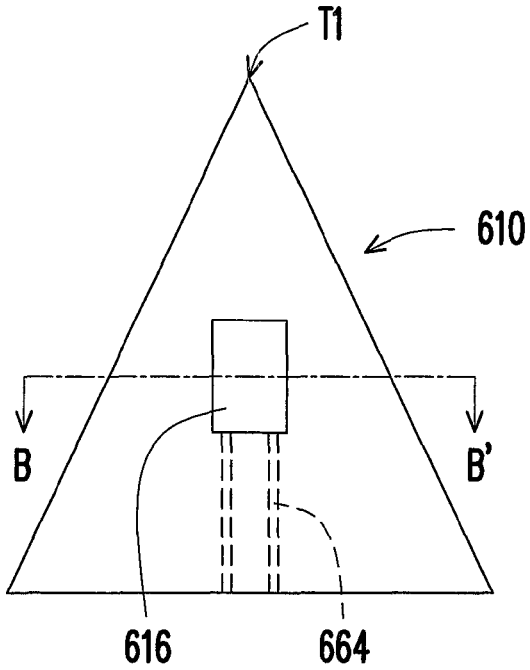
FIG. 13A is a front view facing a light source plate in FIG. 12.
Figure 13B:
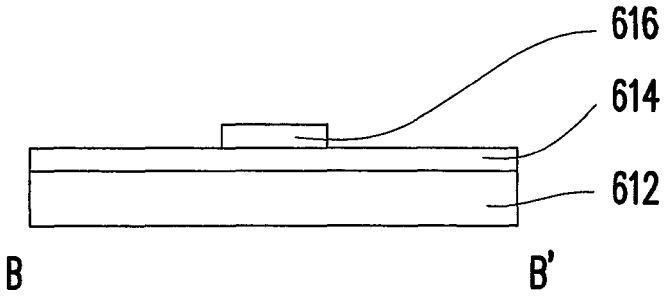
FIG. 13B is a cross-sectional view along line BB' in FIG. 13A when the light source plate is a first light source plate.
Figure 13C:
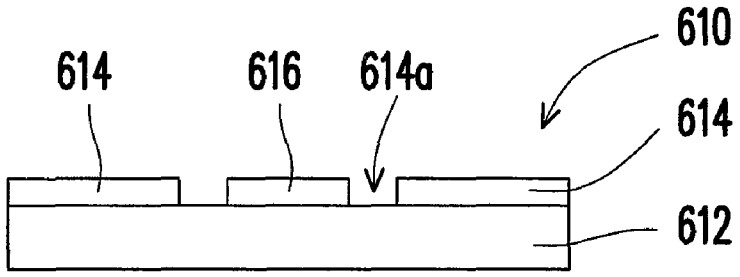
FIG. 13C is a cross-sectional view along line BB' in FIG. 13A when the light source plate is the first light source plate according to another embodiment of the disclosure.
Figure 13D:
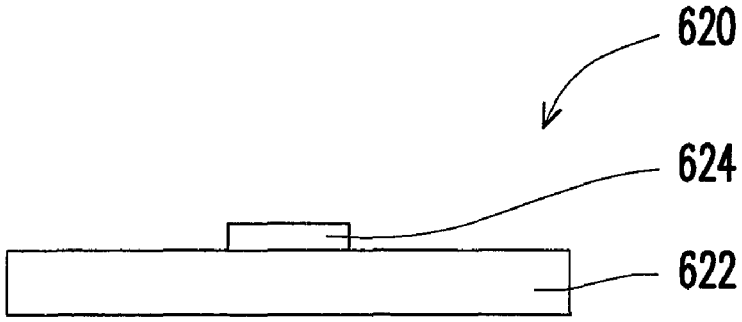
FIG. 13D is a cross-sectional view along line BB' in FIG. 13A when the light source plate is a second light source plate.

FIG. 12 is a diagram of a multi-facet light emitting lamp according to an embodiment of the disclosure, FIG. 13A is a front view facing a light source plate in FIG. 12, FIG. 13B is a cross-sectional view along line BB' in FIG. 13A when the light source plate is a first light source plate, and FIG. 13D is a cross-sectional view along line BB' in FIG. 13A when the light source plate is a second light source plate. Referring to FIG. 12, FIG. 13A, and FIG. 13B, the multi-facet light emitting lamp 600 in the embodiment includes a first light source plate 610, a second light source plate 620, and a plurality of airflow channels 630. The first light source plate 610 has a first connecting terminal T1, and the second light source plate 620 has a second connecting terminal T2, wherein the first connecting terminal T1 is connected with the second connecting terminal T2, and an inner space S1 is formed between the first light source plate 610 and the second light source plate 620. The airflow channels 630 connect the inner space S1 with a space S2 out of the multi-facet light emitting lamp 600.

In the embodiment, the multi-facet light emitting lamp 600 further includes a carrier 650. The first light source plate 610 and the second light source plate 620 are disposed on the carrier 650, and the first light source plate 610, the second light source plate 620, and the carrier 650 form the inner space S1.

As shown in FIG. 13B, the first light source plate 610 includes a conductive substrate 612 and an insulating layer 614, wherein the insulating layer 614 is disposed on the conductive substrate 612. In the embodiment, the first light source plate 610 further includes a light emitting device 616 disposed on the insulating layer 614. In the embodiment, the conductive substrate 612 may be an aluminium substrate, and the material of the insulating layer 614 may be an aluminium oxide. As shown in FIG. 13C, in other embodiments, the insulating layer 614 may be a flexible circuit board. In this case, the flexible circuit board has an opening 614*a*. The opening 614*a* exposes the conductive substrate 612, and the light emitting device 616 is disposed on the conductive substrate 612 exposed by the opening 614*a*. As shown in FIG. 13D, in the embodiment, the second light source plate 620 has a substrate 622 and a light emitting device 624. The substrate 622 may be made of a porous ceramic, such as silicon carbide. Besides, the light emitting device 624 is disposed on the substrate 622.

In the embodiment, because the first light source plate 610 is not physically connected with the adjacent second light source plate 620, aforementioned airflow channels 630 are formed. In other words, the airflow channels 630 are located at where the first light source plate 610 adjoins the second light source plate 620. Accordingly, another two opposite sides of the multi-facet light emitting lamp 600 are open so that air in the inner space can flow out through the airflow channels 630. Thus, when the first light source plate 610 and the second light source plate 620 are driven and accordingly produce heat, the heat is conducted into the external space through the airflow channels 630, so that an optimal heat dissipation performance can be achieved by the multi-facet light emitting lamp 600.

Similarly, the multi-facet light emitting lamp 600 in the embodiment also has a lamp base 662 and a conductive wire 664, as shown in FIG. 12 and FIG. 13A. The lamp base 662 is located below the first light source plate 610 and the second light source plate 620. The conductive wire 664 electrically connects the first light source plate 610 and the second light source plate 620 to the lamp base 662. In the embodiment, the multi-facet light emitting lamp 600 further includes a heat-dissipation lamp housing 670. The heat-dissipation lamp housing 670 is installed below the first light source plate 610 and the second light source plate 620 and above the lamp base 662, and the heat-dissipation lamp housing 670 has a plurality of airflow openings 672. It should be mentioned that the first connecting terminal T1 and the second connecting terminal T2 may be fastened together by using a fixer 690, as shown in FIG. 12. Herein the actual implementation may be referred to foregoing description related to the clasp 130.

Figure 14:
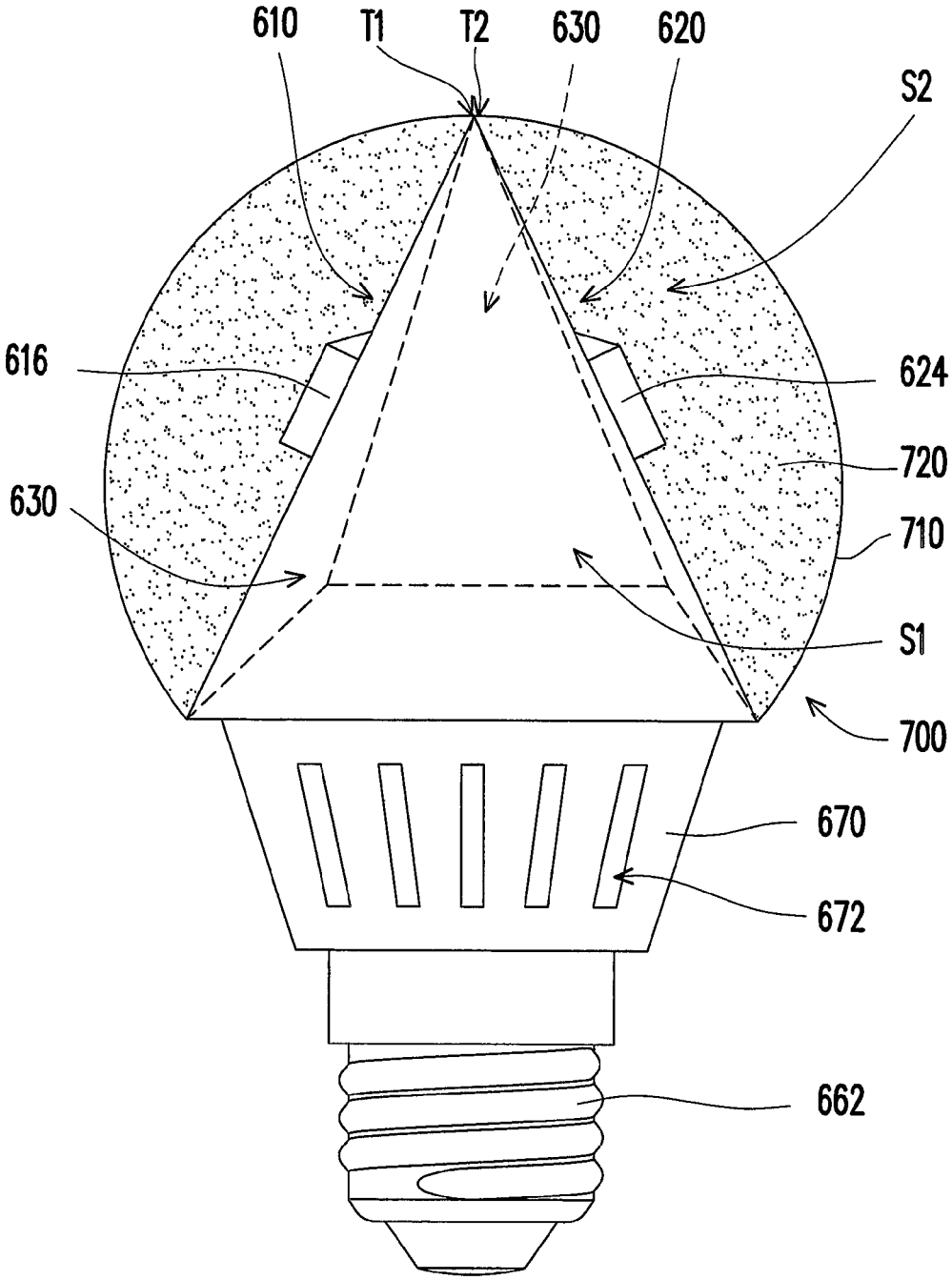
FIG. 14 is a diagram illustrating another implementation of the multi-facet light emitting lamp in FIG. 12.

FIG. 14 is a diagram illustrating another implementation of the multi-facet light emitting lamp in FIG. 12. Referring to FIG. 14, the multi-facet light emitting lamp 700 has a similar structure as the multi-facet light emitting lamp 600. However, the multi-facet light emitting lamp 700 in the embodiment further includes at least one molding compound 710 disposed on at least one of the first light source plate 610 and the second light source plate 620. Besides, a plurality of diffusion particles 720 may be selectively doped in the molding compound 710 for diffusing the light beam emitted by the light emitting device out of the multi-facet light emitting lamp, so as to provide illumination. In an embodiment, the molding compound 710 may also be selectively replaced by a light-transmissive covering, wherein the light-transmissive covering can protect the light emitting device 616 or 624 and diffuse the light beam emitted by the light emitting device 616 or 624 so as to achieve a full light emission effect. The light-transmissive covering may be selectively disposed on at least one of the first light source plate 610 and the second light source plate 620. Similarly, the light-transmissive covering may also be doped with aforementioned diffusion particles.

Figure 15A:
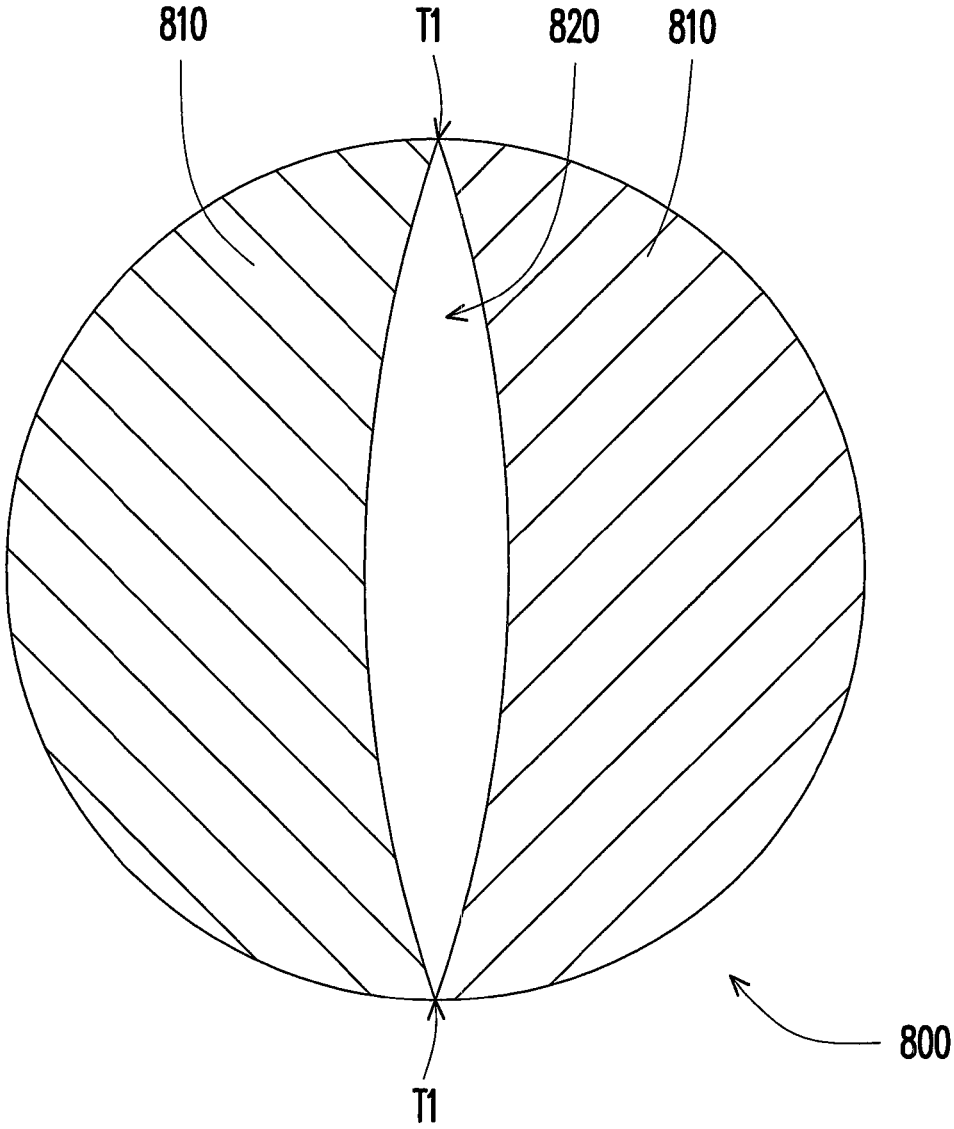
FIG. 15A is a top view of a multi-facet light emitting lamp according to an embodiment of the disclosure.
Figure 15B:
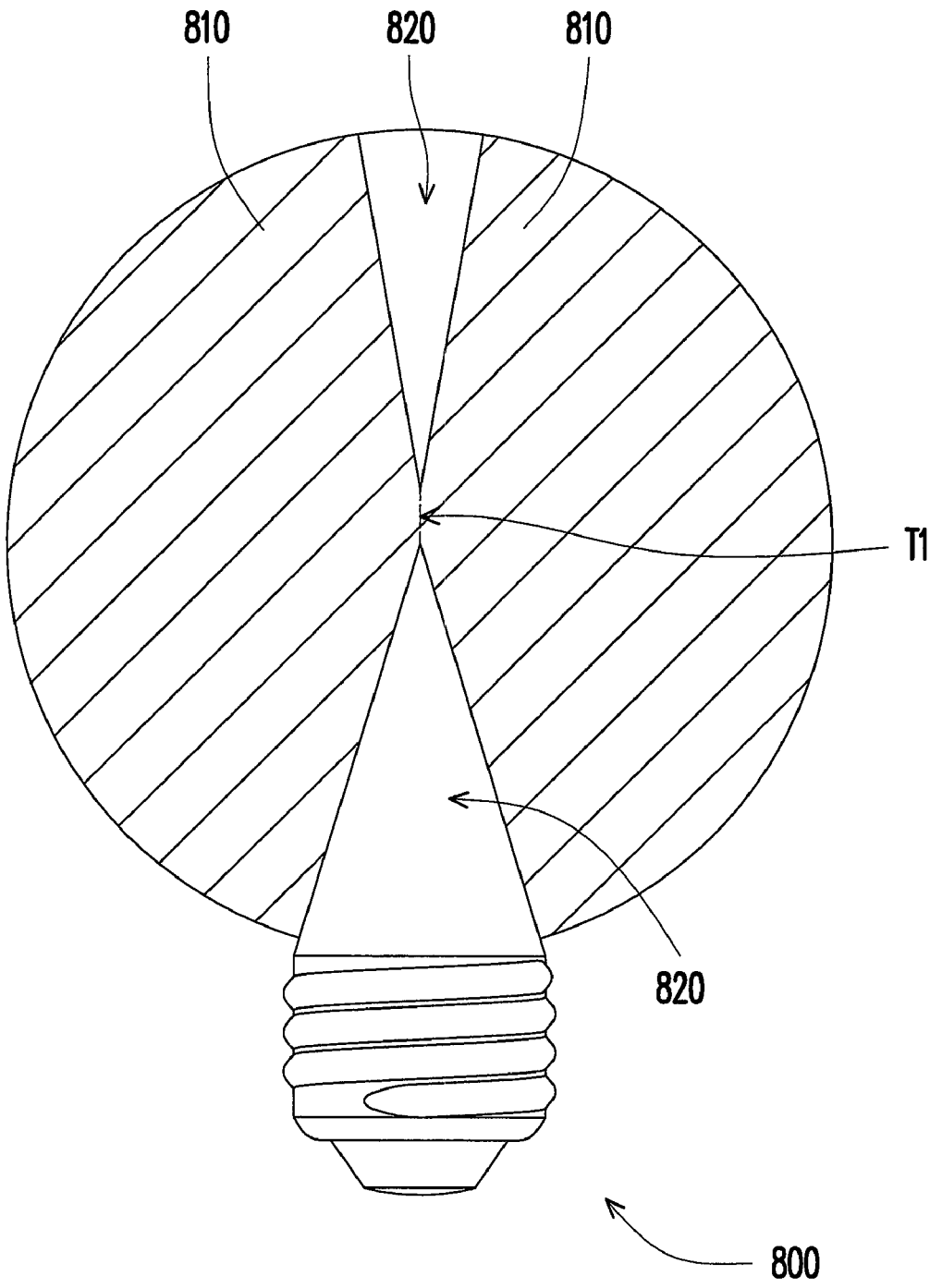
FIG. 15B is a side view of the multi-facet light emitting lamp in FIG. 15A.
Figure 15C:
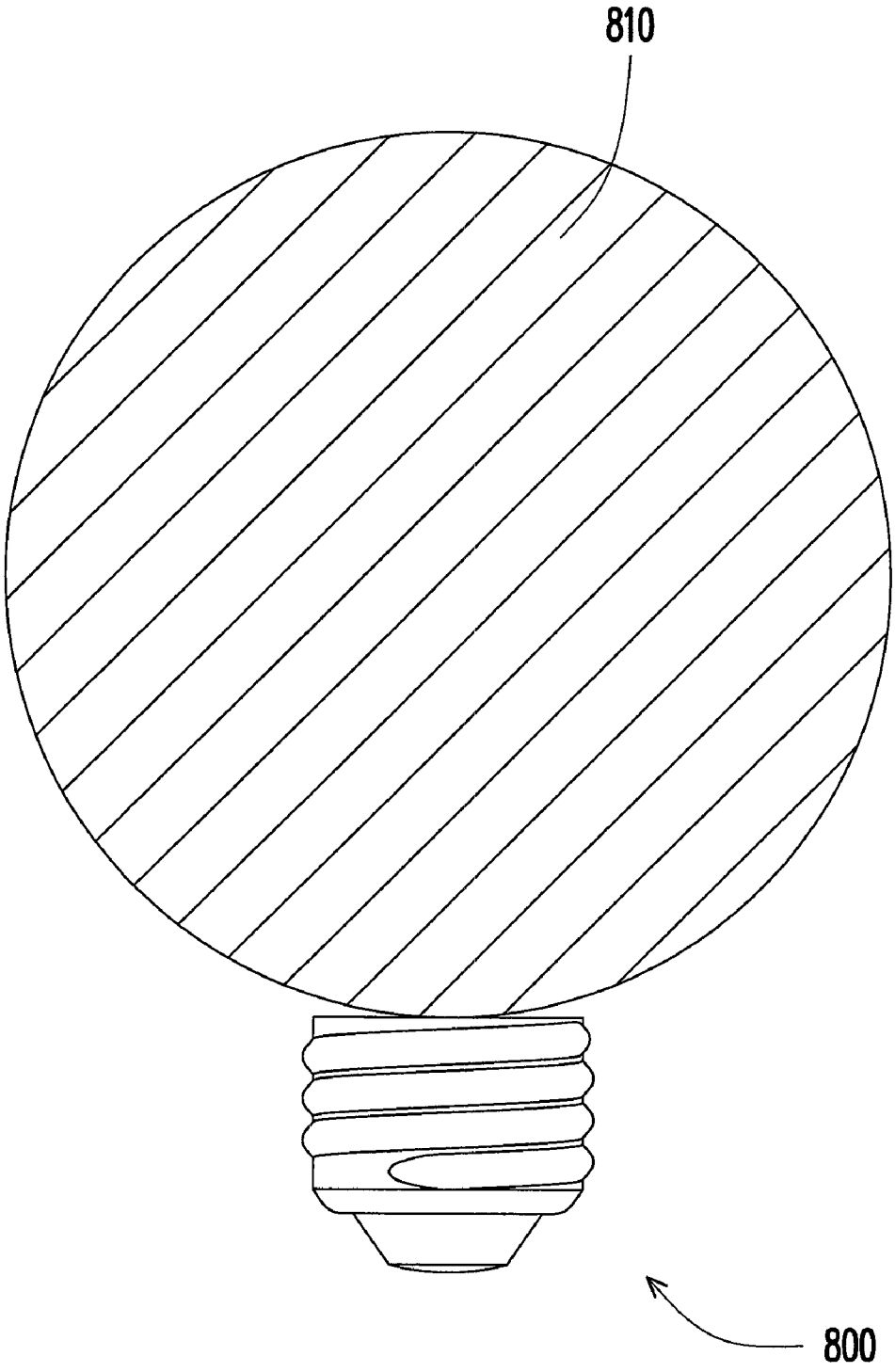
FIG. 15C is a front view of the multi-facet light emitting lamp in FIG. 15A.

FIG. 15A is a top view of a multi-facet light emitting lamp according to an embodiment of the disclosure, FIG. 15B is a side view of the multi-facet light emitting lamp in FIG. 15A, and FIG. 15C is a front view of the multi-facet light emitting lamp in FIG. 15A. referring to FIG. 15A, FIG. 15B, and FIG. 15C, the multi-facet light emitting lamp 800 in the embodiment adopts the same concept as the multi-facet light emitting lamp 600 in FIG. 12. Namely, two light source plates 810 are assembled together, wherein each of the light source plates 810 has a connecting terminal T1, and the two light source plates 810 are connected through the connecting terminals T1. The difference between the multi-facet light emitting lamp 800 in the embodiment and the multi-facet light emitting lamp 600 is that the connecting terminals T1 of the light source plates 810 are located at two sides of the multi-facet light emitting lamp 800, as shown in FIG. 15B. Thus, aforementioned airflow channels 820 can be respectively formed above and below the two connecting terminals T1 of the multi-facet light emitting lamp 800 by bending the two light source plates 810. Similarly, because the multi-facet light emitting lamp 800 has the airflow channels 820 respectively on its upper and lower portion and the airflow channels 820 connect the inner space of the multi-facet light emitting lamp, heat produced by the multi-facet light emitting lamp during it operation can convect through the airflow channels 820 and be conducted out of the inner space of the multi-facet light emitting lamp. Accordingly, a heat dissipation effect is achieved.

Figure 16A:
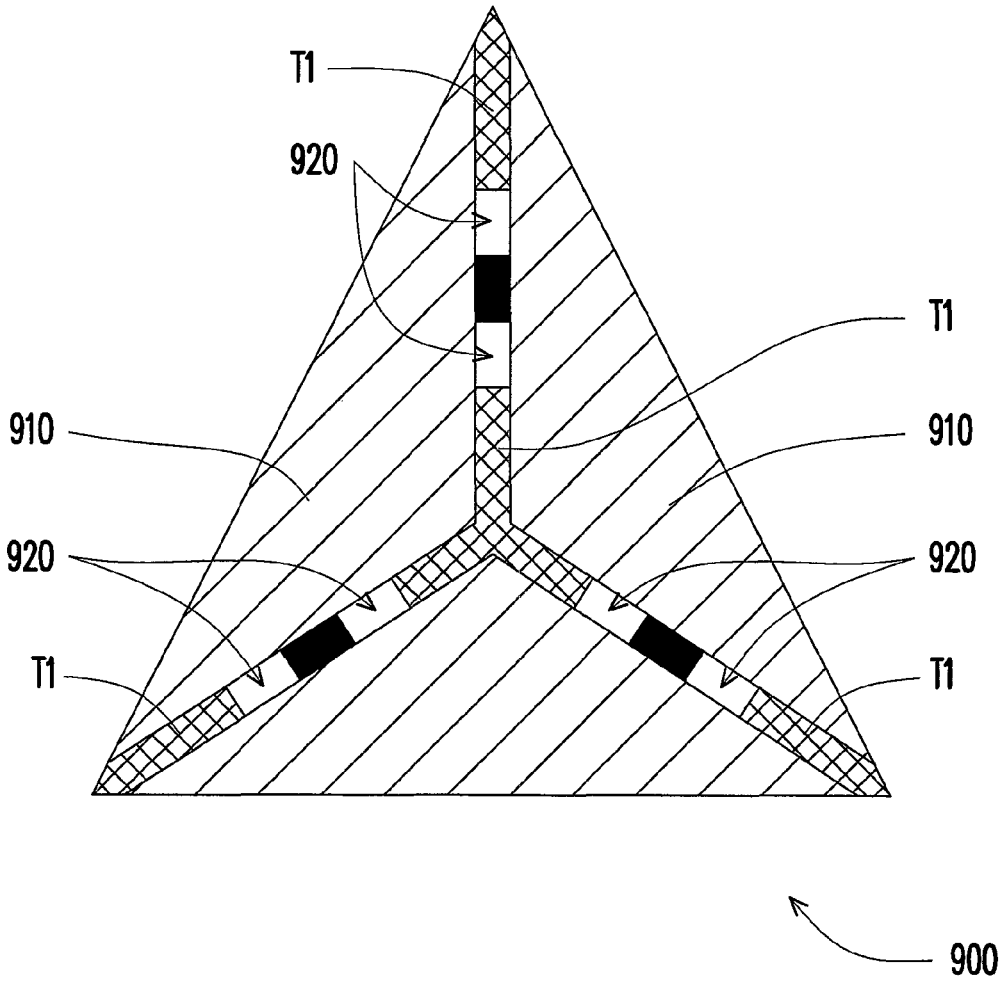
FIG. 16A is a top view of a multi-facet light emitting lamp according to an embodiment of the disclosure.
Figure 16B:
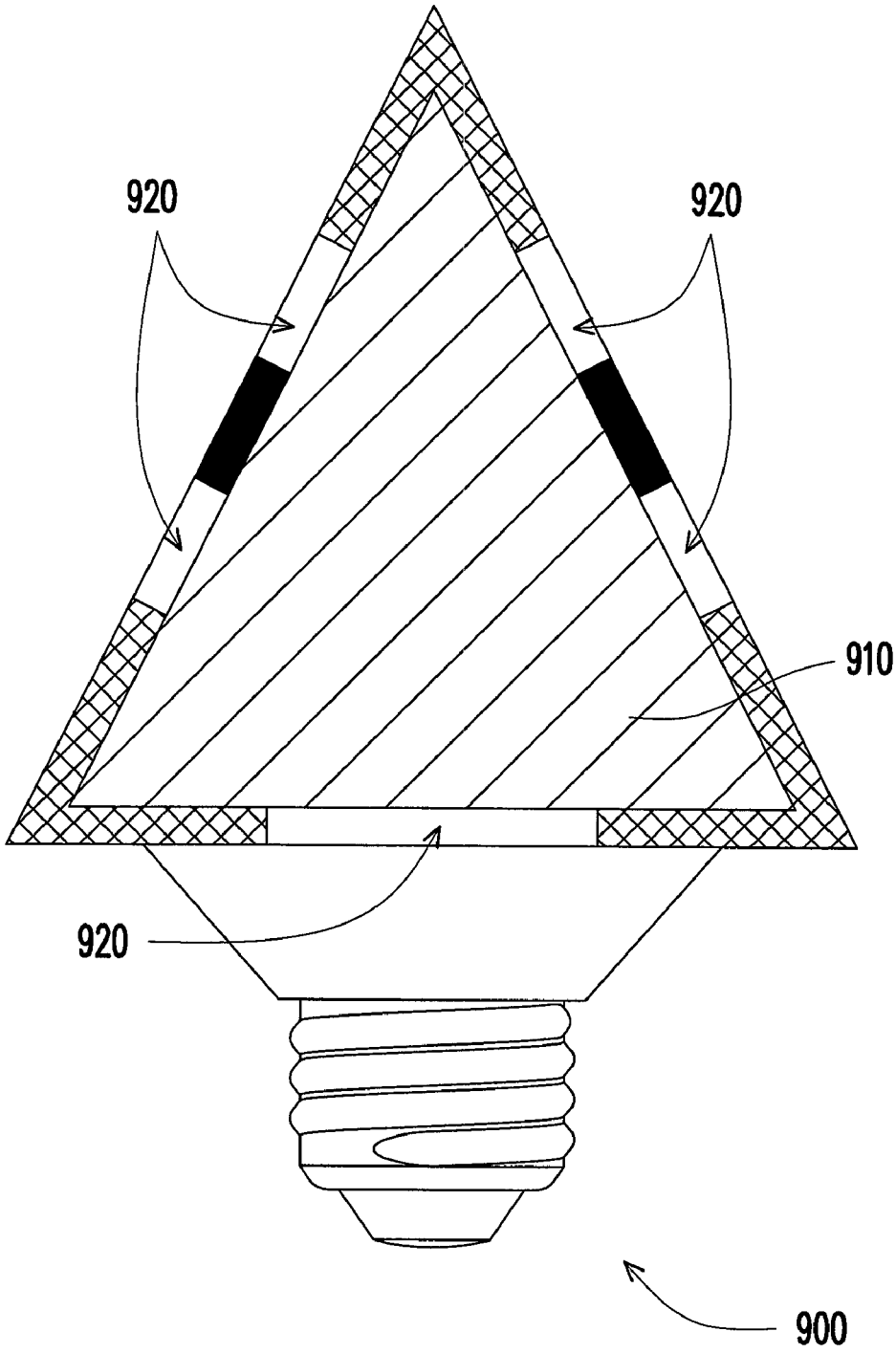
FIG. 16B is a side view of the multi-facet light emitting lamp in FIG. 16A.
Figure 16C:
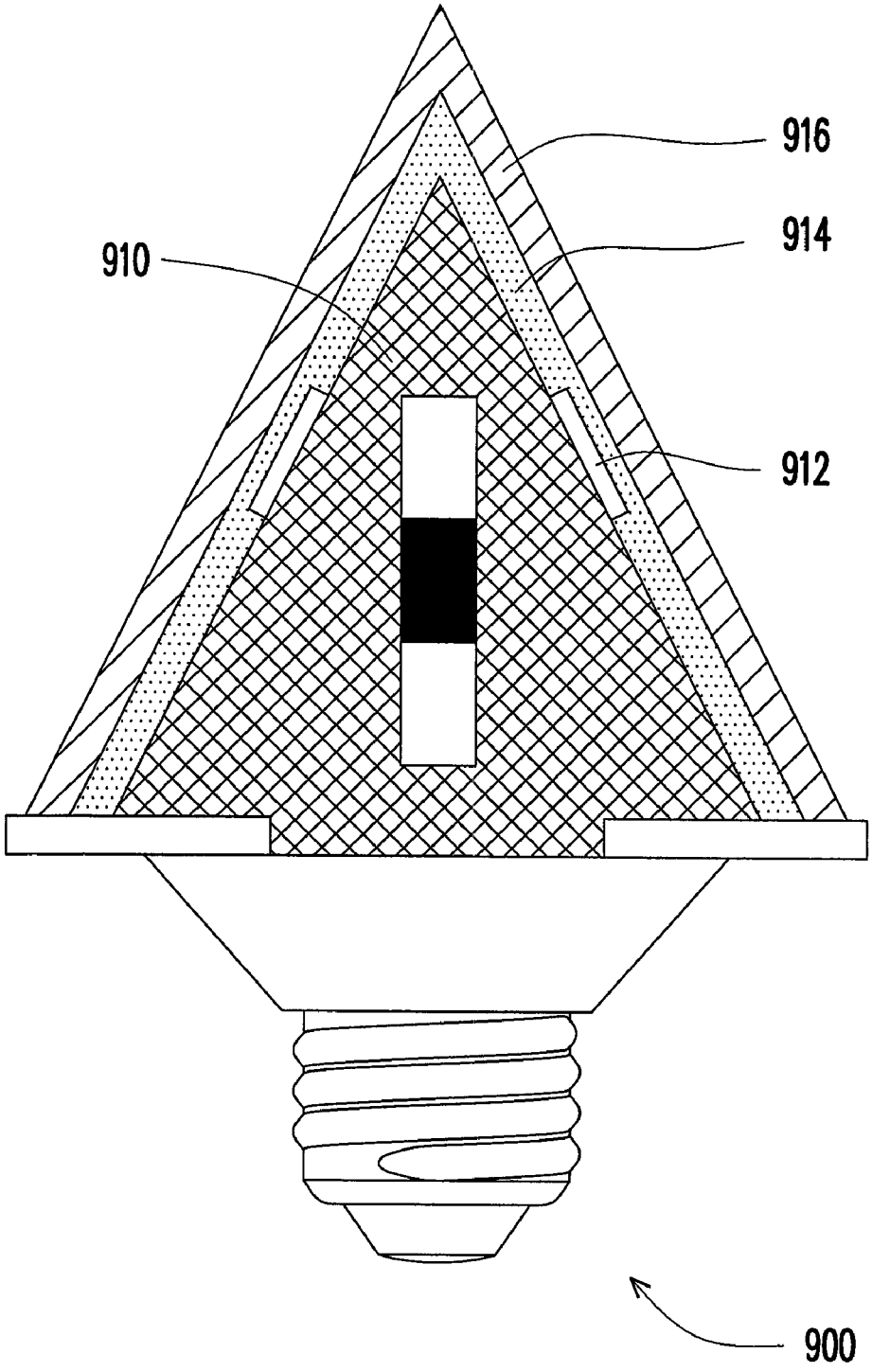
FIG. 16C is a cross-sectional view of the multi-facet light emitting lamp in FIG. 16A.

FIG. 16A is a top view of a multi-facet light emitting lamp according to an embodiment of the disclosure, FIG. 16B is a side view of the multi-facet light emitting lamp in FIG. 16A, and FIG. 16C is a cross-sectional view of the multi-facet light emitting lamp in FIG. 16A. Referring to FIG. 16A, FIG. 16B, and FIG. 16C, the multi-facet light emitting lamp 900 in the embodiment adopts the same concept as the multi-facet light emitting lamp 600 described above. Namely, two light source plates 910 are assembled together, wherein each of the light source plates 910 has a plurality of connecting terminals T1, and the two light source plates 910 are connected through the connecting terminals T1.

As shown in FIG. 16A and FIG. 16B, the difference between the multi-facet light emitting lamp 900 in the embodiment and the multi-facet light emitting lamp 600 illustrated in FIG. 12 is that the connecting terminals T1 of the two light source plates 910 are located on top and bottom of the multi-facet light emitting lamp 900. Accordingly, the triangular pyramid structure illustrated in FIG. 16A, FIG. 16B, and FIG. 16C can be formed by bending and connecting the two light source plates 910. In addition, because the two light source plates are connected through the connecting terminals, the airflow channels 920 are respectively formed between two adjacent connecting terminals T1, as illustrated in FIG. 16A and FIG. 16B. Similarly, because the multi-facet light emitting lamp 900 has the airflow channels 920 respectively on its upper and lower portions and the airflow channels 920 connect the inner space of the multi-facet light emitting lamp, heat produced by the multi-facet light emitting lamp 900 during its operation can convect through the airflow channels 920 and be conducted out of the inner space of the multi-facet light emitting lamp 900. Accordingly, a heat dissipation effect is achieved.

In the embodiment, the light source plates 910 may also have a light emitting device 912, a molding compound 914, and a phosphor layer 916, as illustrated in FIG. 16C. However, the embodiment is not limited thereto, and the light source plates 910 may also adopt the light source plate structures described above.

Figure 17:
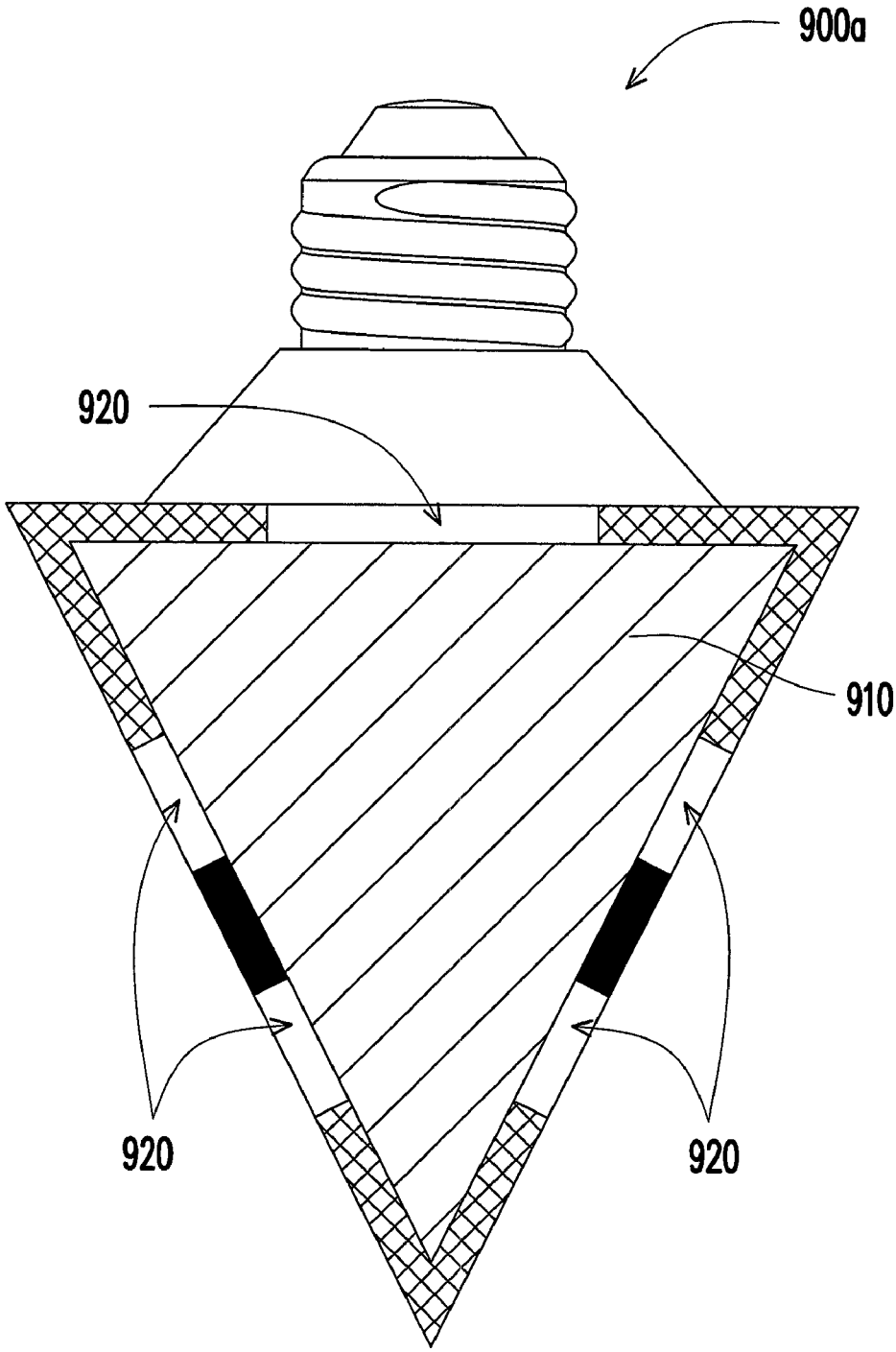
FIG. 17 is a side view of a multi-facet light emitting lamp according to an embodiment of the disclosure.

FIG. 17 is a side view of a multi-facet light emitting lamp according to an embodiment of the disclosure. Referring to FIG. 17, and FIG. 16B, the multi-facet light emitting lamp 900*a* in the embodiment adopts the same concept as the multi-facet light emitting lamp 900 illustrated in FIG. 16A. However, in the multi-facet light emitting lamp 900*a* provided by the embodiment, air enters the multi-facet light emitting lamp 900*a* through the airflow channels on the top of the triangular pyramid and brings the heat produced by the multi-facet light emitting lamp 900*a* out of the multi-facet light emitting lamp 900*a* through the airflow channels at the bottom of the triangular pyramid, so that a heat dissipation effect is achieved. However, the airflow in the multi-facet light emitting lamp 900 illustrated in FIG. 16B has a reversed direction as that in the multi-facet light emitting lamp 900*a* provided by the embodiment. This is also based on the fact that warm air rises and cold air falls as mentioned in the embodiments described above therefore will not be described herein.

Figure 18:
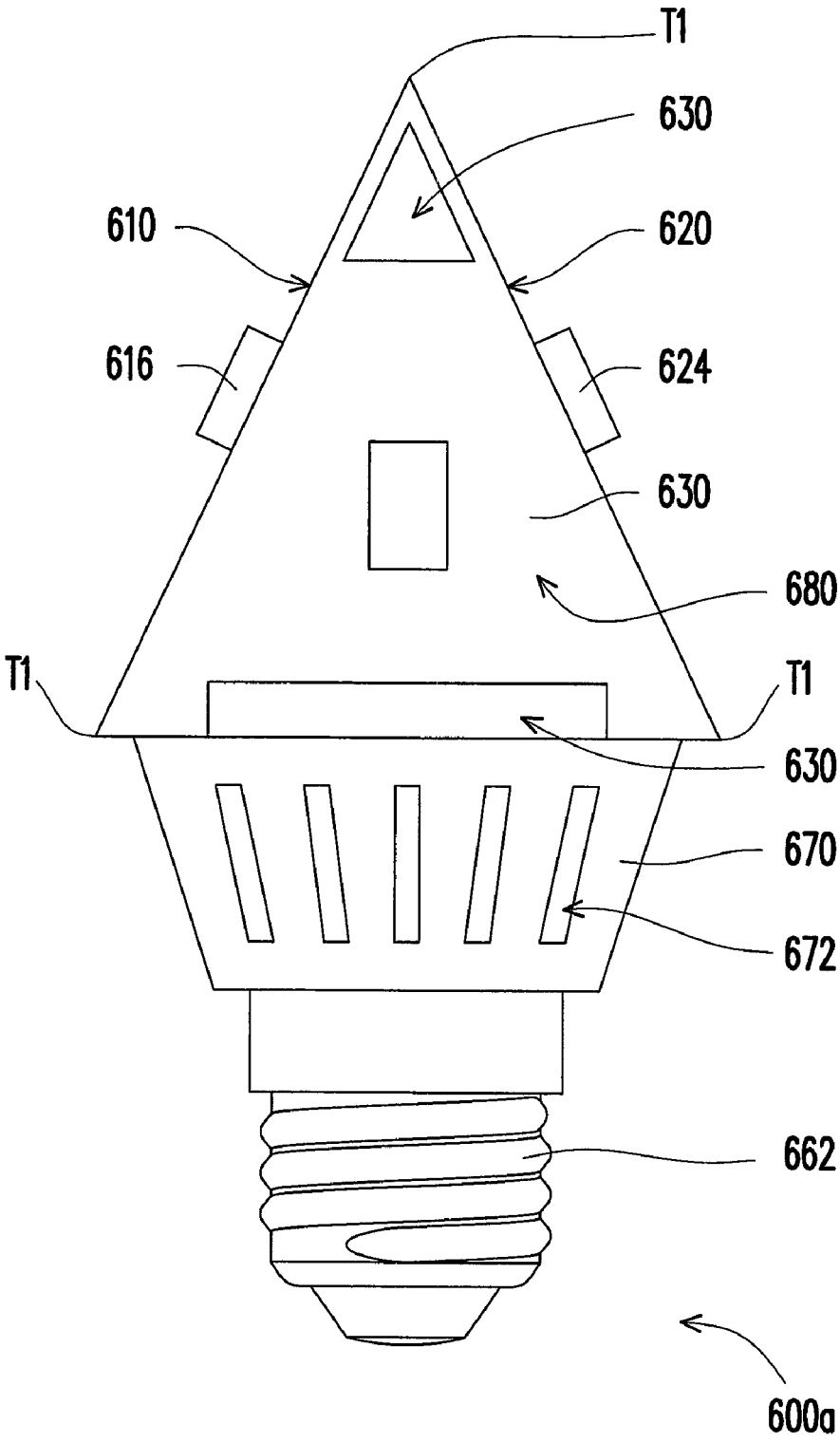
FIG. 18 is a front view of a multi-facet light emitting lamp according to an embodiment of the disclosure.

FIG. 18 is a front view of a multi-facet light emitting lamp according to an embodiment of the disclosure. Referring to FIG. 18 and FIG. 12, the multi-facet light emitting lamp 600*a* in the embodiment adopts the same structure and concept as the multi-facet light emitting lamp 600 described above. However, the multi-facet light emitting lamp 600*a* further includes a third light source plate 680. The third light source plate 680 also has connecting terminals T1 for connecting adjacent light source plates 610 and 620. Similarly, the multi-facet light emitting lamp 600*a* also has the airflow channels 630. Besides being located at where the light source plates 610, 620, and 630 adjoin each other, the airflow channels 630 may also be formed on the top of the third light source plate 680 by drilling holes. Thus, when the first light source plate 610, the second light source plate 620, and the third light source plate 630 are driven to produce heat, the heat convects through the airflow channels 630 and is conducted out of the multi-facet light emitting lamp 600*a*. Accordingly an optimal heat dissipation effect is achieved by the multi-facet light emitting lamp 600*a*.

It should be noted that each of foregoing light source plates uses a light emitting diode (LED) chip for emitting light. Thus, epoxy can be used to reduce the packaging cost. Or, metal substrate or conventional plastic circuit board may also be directly adopted for packaging. In addition, if pentagonal light source plates and hexagonal light source plates are used for constructing the football-like body, the number of pentagonal light source plates should be 12 and the number of hexagonal light source plates should be 20 in order to form a ball. However, some of the light source plates may be selectively removed for other purpose if the user needs to increase the number of airflow openings or install a supporting frame according to the actual requirement.

In summary, a multi-facet light emitting lamp in the disclosure has at least following advantages. In the multi-facet light emitting lamp provided by an embodiment, a plurality of light source plates are assembled, and a plurality of airflow channels are formed at where the light source plates adjoin each other, wherein the airflow channels connect the external space and the inner space of the multi-facet light emitting lamp. Thus, when the multi-facet light emitting lamp is driven, the heat produced by the multi-facet light emitting lamp and distributed in the inner space of the multi-facet light emitting lamp can be conducted out of the multi-facet light emitting lamp through a heat convection effect of the airflow channels. Thereby, a heat dissipation effect is achieved.

Additionally, because the airflow channels are distributed everywhere (the upper and lower portions) on the multi-facet light emitting lamp, based on the fact that warm air rises and cold air falls, heat produced by the light emitting devices rises towards the airflow channels on the upper portion and is conducted out of the multi-facet light emitting lamp, while fresh air of lower temperature enters the inner space from the external space through the airflow channels on the lower portion. In other words, the multi-facet light emitting lamp in the embodiment has an optimal heat convection structure such that heat can be effectively conducted out of the multi-facet light emitting lamp without adopting any conventional heat dissipating fin or cooling device. Thereby, the cost and volume of the lamp are reduced.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A multi-facet light emitting lamp, comprising:

a first light source plate, having at least one first connecting terminal;

a second light source plate, having at least one second connecting terminal, wherein the first connecting terminal is connected with the second connecting terminal, and an inner space is formed between the first light source plate and the second light source plate; and a plurality of airflow channels, for connecting the inner space and a space outside the multi-facet light emitting lamp.

2. The multi-facet light emitting lamp according to claim 1, wherein the airflow channels are located at where the first light source plate adjoins the second light source plate.

3. The multi-facet light emitting lamp according to claim 1, wherein the airflow channels are located on the first light source plate and the second light source plate.

4. The multi-facet light emitting lamp according to claim 1, wherein the first light source plate and the second light source plate respectively comprise a conductive substrate and an insulating layer, wherein the insulating layer is on the conductive substrate.

5. The multi-facet light emitting lamp according to claim 4 further comprising a light emitting device disposed on the insulating layer.

6. The multi-facet light emitting lamp according to claim 4, wherein the conductive substrate is an aluminum substrate, and a material of the insulating layer is an aluminum oxide.

7. The multi-facet light emitting lamp according to claim 4, wherein the insulating layer is a flexible circuit board.

8. The multi-facet light emitting lamp according to claim 7, wherein the flexible circuit board comprises an opening and a light emitting device, the opening exposes the conductive substrate, and the light emitting device is disposed on the conductive substrate exposed by the opening.

9. The multi-facet light emitting lamp according to claim 1 further comprising:

a lamp base, located below the first light source plate and the second light source plate; and a conductive wire, for electrically connecting the first light source plate and the second light source plate to the lamp base.

10. The multi-facet light emitting lamp according to claim 9 further comprising a heat-dissipation lamp housing installed below the first light source plate and the second light source plate and above the lamp base.

11. The multi-facet light emitting lamp according to claim 10, wherein the heat-dissipation lamp housing has a plurality of airflow openings.

12. The multi-facet light emitting lamp according to claim 1 further comprising a third light source plate, wherein the third light source plate has at least one third connecting terminal, the third connecting terminal is connected with the first connecting terminal and the second connecting terminal, and the first light source plate, the second light source plate, and the third light source plate enclose the inner space.

13. The multi-facet light emitting lamp according to claim 1, wherein an appearance of at least one of the first light source plate and the second light source plate comprises one or a combination of a circular shape, a triangular shape, a rectangular shape, a quadrangular shape, a pentagonal shape, a hexagonal shape, and a polygonal shape.

14. The multi-facet light emitting lamp according to claim 1, wherein when there are multiple first light source plates and multiple second light source plates, the first light source plates and the second light source plates are connected with each other to form a football-like body, and the inner space is in the football-like body.

15. The multi-facet light emitting lamp according to claim 14, wherein an outline of the first light source plates and the second light source plates comprises one or a combination of a circular shape, a triangular shape, a rectangular shape, a quadrangular shape, a pentagonal shape, a hexagonal shape, and a polygonal shape.

16. The multi-facet light emitting lamp according to claim 14 further comprising a fan, wherein the fan is disposed on a casing of the football-like body and forms an airflow between the inner space and the space outside the multi-facet light emitting lamp.

17. The multi-facet light emitting lamp according to claim 16, wherein the fan is located on top or at bottom of the football-like body.

18. The multi-facet light emitting lamp according to claim 14 further comprising a wireless control module, wherein the wireless control module is disposed on a casing of the football-like body and configured to receive an external signal to turn on or off the first light source plates and the second light source plates.

19. The multi-facet light emitting lamp according to claim 16, wherein the wireless control module is located on top or at bottom of the football-like body.

20. The multi-facet light emitting lamp according to claim 14 further comprising:

a supporting trunk, extended into the inner space and supporting the football-like body; and a plurality of supporting branches, located on the supporting trunk and inside the inner space, for supporting the first light source plates and the second light source plates.

21. The multi-facet light emitting lamp according to claim 20, wherein at least one of the supporting trunk and the supporting branches is hollow.

22. The multi-facet light emitting lamp according to claim 21, wherein when the supporting trunk is hollow, the multi-facet light emitting lamp further comprises a plurality of conductive wires respectively and electrically connected to the first light source plates and the second light source plates.

23. The multi-facet light emitting lamp according to claim 20, wherein the supporting trunk has a shape of a hollow column, and the supporting branches comprise a bracket and a supporting holder, wherein the supporting holder is connected to a free end of the bracket.

24. The multi-facet light emitting lamp according to claim 20, wherein the supporting trunk has a shape of a hollow ball connected with a hollow column, and the supporting branches comprise a bracket and a supporting holder, wherein the supporting holder is connected to a free end of the bracket.

25. The multi-facet light emitting lamp according to claim 1 further comprising at least one molding compound disposed on at least one of the first light source plate and the second light source plate.

26. The multi-facet light emitting lamp according to claim 25 further comprising a plurality of diffusion particles disposed in the molding compound.

27. The multi-facet light emitting lamp according to claim 1 further comprising at least one light-transmissive covering disposed on at least one of the first light source plate and the second light source plate.

28. The multi-facet light emitting lamp according to claim 1 further comprising a fixer for connecting the first connecting terminal and the second connecting terminal.

* * * * *